US006463964B2

(12) United States Patent
Clüsserath

(10) Patent No.: US 6,463,964 B2
(45) Date of Patent: Oct. 15, 2002

(54) METHOD OF OPERATING A MACHINE FOR FILLING BOTTLES, CANS OR THE LIKE BEVERAGE CONTAINERS WITH A BEVERAGE, AND A BEVERAGE CONTAINER FILLING MACHINE

(75) Inventor: Ludwig Clüsserath, Bad Kreuznach (DE)

(73) Assignee: KHS Maschinen- und Anlagenbau AG, Dortmund (DE)

( * ) Notice: Subject to any disclaimer, the term of this patent is extended or adjusted under 35 U.S.C. 154(b) by 0 days.

(21) Appl. No.: 09/877,225

(22) Filed: Jun. 8, 2001

(65) Prior Publication Data

US 2002/0014276 A1 Feb. 7, 2002

(30) Foreign Application Priority Data

Jun. 9, 2000 (DE) ..... 100 28 676

(51) Int. Cl.[7] ..... B65B 31/00

(52) U.S. Cl. ..... 141/40; 141/63; 141/64; 141/104

(58) Field of Search ..... 141/40, 39, 44, 141/45, 47, 48, 49, 50, 57, 59, 62–64, 6, 145, 104, 197, 198

(56) References Cited

U.S. PATENT DOCUMENTS

| | | | | |
|---|---|---|---|---|
| 3,460,589 A | * | 8/1969 | Justis | 141/39 |
| 4,526,730 A | * | 7/1985 | Cochran et al. | 141/17 |
| 4,636,337 A | * | 1/1987 | Gupta et al. | 141/311 R |
| 4,655,029 A | * | 4/1987 | Weiss | 141/6 |
| 4,860,802 A | * | 8/1989 | Yamaguchi et al. | 141/40 |
| 4,940,212 A | * | 7/1990 | Burton | 141/382 |
| 5,635,232 A | * | 6/1997 | Wallace | 141/18 |
| 6,065,510 A | * | 5/2000 | Andersson et al. | 141/104 |
| 6,079,460 A | * | 6/2000 | Ballan et al. | 141/49 |

* cited by examiner

*Primary Examiner*—Charles R. Eloshway
*Assistant Examiner*—Khoa Huynh
(74) *Attorney, Agent, or Firm*—Nils H. Ljungman & Associates

(57) ABSTRACT

A method of operating a carbonated beverage filling machine for filling beverage containers, such as beverage bottles and beverage cans, with a beverage, and also a carbonated beverage filling machine for filling beverage containers, such as beverage bottles and beverage cans, with a beverage. The beverage in the corresponding container, such as beverage bottles and beverage cans, is carbonated in the container, such as beverage bottles and beverage cans, while the container, such as beverage bottles and beverage cans, is being filled in the carbonated beverage filling machine for filling beverage containers, such as beverage bottles and beverage cans.

20 Claims, 6 Drawing Sheets

METHOD OF OPERATING A MACHINE FOR FILLING BOTTLES, CANS OR THE LIKE BEVERAGE CONTAINERS WITH A BEVERAGE, AND A BEVERAGE CONTAINER FILLING MACHINE

BACKGROUND OF THE INVENTION

1. Field of the Invention

The invention relates to a method of operating a machine for filling bottles, cans, or the like containers, with a liquid filling material, particularly with beverages, using a filling machine having a plurality of filling positions, each comprising a filling device or element at which the container, at least during a portion of the filling process, is operatively connected in sealed manner with a container mouth, and via which filling device the interior space of the container, in a filling phase, is in controlled manner filled with liquid filling material, and in at least one process step carbonated under pressure. The invention further relates to a machine comprising a filling machine and a container sealing arrangement, said filling machine comprising a filling machine for filling bottles, cans, or the like containers, with a liquid filling material, with a plurality of filling positions, each of which comprises a filling device at which the corresponding container, at least during a portion of a filling process, is operatively connected with a container mouth in sealed manner and by way of which filling device the interior space of the container, in a filling phase and in controlled manner, is filled with the liquid filling material and in at least one method step is carbonated under pressure.

2. Background Information

Nowadays it is customary to produce carbonated beverages, prior to filling into bottles, cans, or the like containers, in a mixing equipment in which mixing to the fullest is carried out which precedes the filling machine in the equipment train, by mixing water with at least one further component and by subsequent mixing or treating with carbon dioxide (carbonation); and in particular the latter step is being carried out in a carbonation apparatus, which apparatus forms a part of the mixing equipment, or which comprises a separate piece of equipment. This means, inter alia, that there will be a need for carbonation apparatus in addition to the filling machine.

OBJECT OF THE INVENTION

It is the aim of the invention to provide a method which yields a simplification in the manufacture of filled carbon dioxide containing products, particularly for the case of carbon dioxide containing beverages.

SUMMARY OF THE INVENTION

The invention teaches that this object can be accomplished by a method of operating a plant for filling beverage containers with liquid beverage filling material using a beverage filling machine and a container sealing arrangement, said beverage filling machine having a plurality of beverage filling positions, each beverage filling position comprising a beverage filling device for filling beverage containers, said method comprising the steps of: moving beverage containers to be filled to said filling machine; sealing the beverage containers to be filled against corresponding beverage filling devices; introducing a flow of liquid beverage filling material into the interior of each of said sealed beverage containers; filling each of said sealed beverage containers to a substantially predetermined level with said liquid beverage filling material; terminating the step of filling said sealed beverage containers upon reaching said predetermined level in each of said sealed beverage containers; introducing carbon dioxide gas into the liquid beverage filling material present in said sealed beverage containers at a pressure sufficient to effectuate mixing of said liquid beverage material with carbon dioxide gas, and mixing said liquid beverage filling material and carbon dioxide in said sealed beverage containers and thus effectuating absorption of carbon dioxide into said liquid beverage filling material; terminating the step of introducing carbon dioxide gas; distancing beverage containers filled with said liquid beverage filling material mixed with carbon dioxide from the corresponding beverage filling devices; removing said beverage containers filled with liquid beverage filling material mixed with carbon dioxide from said beverage filling machine; said method further comprising the steps of: moving said beverage containers filled with said liquid beverage filling material mixed with carbon dioxide from said beverage filling machine to said container sealing arrangement; moving said beverage containers filled with said liquid beverage filling material mixed with carbon dioxide into said container sealing arrangement; and sealing each of said beverage containers filled with said liquid beverage filling material mixed with carbon dioxide and containing said liquid beverage filling material mixed with carbon dioxide in each of said beverage containers and thus preventing the carbon dioxide in said beverage containers filled with said liquid beverage filling material mixed with carbon dioxide from substantially leaking from said beverage containers filled with said liquid beverage filling material mixed with carbon dioxide at least prior to shipping; said method yet further comprising the step of: preparing the sealed beverage containers filled with said liquid beverage filling material mixed with carbon dioxide for shipping from said plant to consumers.

The invention further teaches a method of operating a plant for filling beverage containers with liquid beverage filling material using a beverage filling machine having a plurality of beverage filling positions, each filling position comprising a beverage filling device for filling a beverage container, each filling device comprising a return gas tube and a carbonation tube, said method comprising the steps of: moving a beverage container to be filled in sequence with other containers to said filling machine; elevating said beverage container to be filled to a corresponding filling device thereby introducing a corresponding return gas tube and a corresponding carbonation tube of said beverage filling device through the mouth of said beverage container into the interior of said beverage container, and positioning said carbonation tube deeper into said beverage container than said return gas tube; sealing said beverage container to be filled against the corresponding filling device; purging said sealed beverage container by introducing a carbon dioxide containing gas into the interior of said sealed beverage container by way of said carbonation tube, to thereby displace residual air present out of said sealed beverage container; terminating said step of purging with a carbon dioxide containing gas; at the end of said purging step, introducing a flow of a predetermined volume of non-carbonated liquid beverage filling material into the interior of said sealed beverage container with a filling device without adding additional carbon dioxide gas; terminating the step of flowing non-carbonated liquid beverage filling material into the interior of said sealed beverage container; introducing a predetermined quantity of carbon dioxide gas through said carbonation tube into the liquid beverage filling material present in said sealed beverage container, in a sufficient quantity with a sufficient pressure to effect carbonation with a sufficient saturation of said liquid beverage filling material in said sealed beverage container to absorb carbon dioxide in said liquid beverage filling material, at a pressure level above the saturation pressure sufficient to produce a carbonated beverage; terminating the step of introducing carbon dioxide gas; calming the carbonated beverage filling material in said sealed beverage container for a predetermined period of time to attain a pressure markedly below the carbon dioxide saturation pressure and thus removing excess gas bubbles; reducing the gas pressure in said sealed beverage container to a final pressure; distancing said filled beverage container filled with carbonated liquid beverage from the sealing relationship with the corresponding filling device; and removing said filled beverage container from said filling machine.

The invention also teaches a plant for filling beverage containers with liquid beverage filling material, said plant comprising: a beverage filling machine; said beverage filling machine comprising a plurality of beverage filling positions, each beverage filling position comprising a beverage filling device for filling beverage containers; apparatus to move beverage containers to be filled to said filling machine; apparatus to seal the beverage containers to be filled against corresponding beverage filling devices; said filling devices comprising apparatus to introduce a flow of liquid beverage filling material into the interior of each of said sealed beverage containers to fill each of said sealed beverage containers to a substantially predetermined level with said liquid beverage filling material; said apparatus to introduce a flow of liquid beverage filling material comprising apparatus to terminate the filling of said sealed beverage containers upon reaching said predetermined level in each of said sealed beverage containers; apparatus to introduce carbon dioxide gas into the liquid beverage filling material present in said sealed beverage containers to a pressure sufficient to effectuate mixing of said liquid beverage material with carbon dioxide gas in said sealed beverage containers, and to mix said liquid beverage filling material and carbon dioxide in said sealed beverage containers and thus to effectuate absorption of carbon dioxide into said liquid beverage filling material; said apparatus to introduce carbon dioxide gas comprising apparatus to terminate introduction of carbon dioxide gas; said apparatus to seal the beverage containers to be filled against corresponding beverage filling devices comprising apparatus to distance beverage containers, filled with said liquid beverage filling material mixed with carbon dioxide, from the corresponding beverage filling devices; and said apparatus to move beverage containers to be filled comprising apparatus to remove said beverage containers filled with liquid beverage filling material mixed with carbon dioxide from said beverage filling machine; said plant further comprising: a container sealing arrangement configured to seal filled beverage containers filled by said filling machine; said container sealing arrangement comprising: apparatus to position filled beverage containers in said container sealing arrangement; and apparatus to seal filled beverage containers, filled with said liquid beverage filling material mixed with carbon dioxide, and thus preventing the carbon dioxide in said beverage containers filled with said liquid beverage filling material mixed with carbon dioxide from substantially leaking from said beverage containers filled with said liquid beverage filling material mixed with carbon dioxide.

The invention further teaches a method characterized thereby that the liquid filling material in the corresponding container is mixed or, respectively, carbonated, by the introduction of a carbon dioxide gas under pressure; and by a filling machine for carrying out the method characterized that by means for carbonation of the liquid filling material in the corresponding container by introduction of the carbon dioxide gas under pressure into the filling material.

The invention is particularly addressed thereto that the mixing/treating of the filling material with carbon dioxide, that is, carbonation of the filling material is not carried out in carbonation equipment or apparatus, but is done in the filling machine, that is, in the corresponding container.

The filling material, for example, water of a fully mixed beverage without carbon dioxide, or with a reduced content of carbon dioxide, or with a negligible content of carbon dioxide, is passed to the container at the corresponding filling location and only there is provided with carbon dioxide gas in such a way that ultimately the filling material in the container comprises the required content of carbon dioxide.

The method in accordance with the invention provides for an operation without the hitherto necessary carbonation equipment or installation that precedes the filler in the equipment train, for example, during production of filled beverages containing carbon dioxide, such a mineral water, or table water, lemonades, and so forth. It is particularly possible to directly pass, for example, beverages which are mixed to the fullest in a tank, directly to the filling machine.

Further embodiments of the invention are the subject of dependent claims.

The above-discussed embodiments of the present invention will be described further herein below. When the word "invention" is used in this specification, the word "invention" includes "inventions"that is, the plural of "invention"By stating "invention"the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The invention is further explained in the following with reference to the embodiments which are illustrated in the accompanying drawings.

DESCRIPTION OF THE PREFERRED EMBODIMENT

Figure 1:
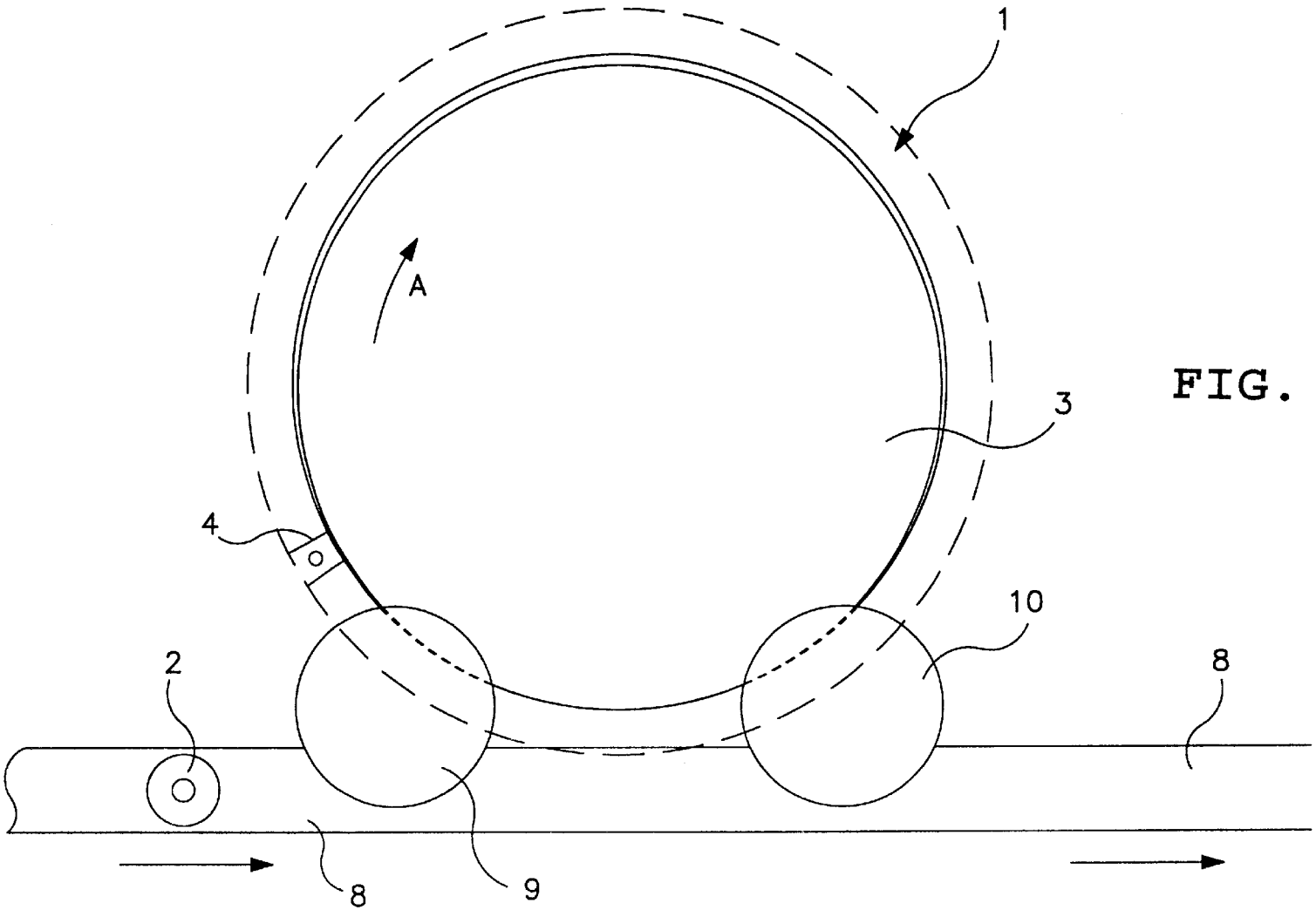
FIG. 1: in very simplified manner and in top plan view a filling machine of revolving type for filling containers.

The filling machine, generally identified by reference numeral 1, serves to fill containers, namely, bottles 2, with a filling material comprising a beverage, for example, lemonades, table waters, and mineral waters; the machine also serves to provide the subsequent provision of carbon dioxide or, respectively, carbon dioxide gas (carbonation), in the filling material in the corresponding bottle 2. The filling machine, as is known, has a rotor 3 which rotates in reference to a vertical machine axis, at which rotor is provided a plurality of filling positions which are positioned in uniform angular positions, these filling positions being correspondingly configured by a filling device 4 and a container carrier 5, which container carrier, according to the illustrated embodiment, interacts with the corresponding bottle 2 at a flange which is formed at the neck of the bottle in the vicinity of the mouth 2' of the bottle, in controlled manner, by way of a fixed lifting curve 6 and a lifting piston-cylinder unit 7; this carrier carries out a vertical lifting movement for raising and lowering the bottle 2 with reference to the pertaining filling device 4, that is, it moves a bottle to the filling device, or away from the filling device.

The upright bottles 2 are individually passed, by means of a conveyor 8, at a bottle input 9 to the filling locations 4/5. The full bottles 2 with carbonated filling material are withdrawn at a bottle output 10 from the filling locations 4/5 and are again passed to the conveyor 8. In this equipment, the rotor 3 is driven in the direction of arrow A of FIG. 1.

Between the bottle input 9 and the bottle output 10 there is performed the filling and carbonation procedure for the bottles 2 which have been raised to be in operative contact with the filling devices 4 and are positioned thereto in sealed manner, the procedure comprising several process steps, that is, in the illustrated embodiment, a total of six process step which are carried out in timed manner, namely:

purging of the pertaining bottle 2 with a carbon dioxide gas, filling of the pertaining bottle 2 with the liquid filling material (beverage) that is free of carbon dioxide, prepressurizing of the filled bottle with carbon dioxide gas, carbonation of the filling material, calming and predepressurization of the bottle filled with carbonated filling material, final depressurization.

Figure 2:
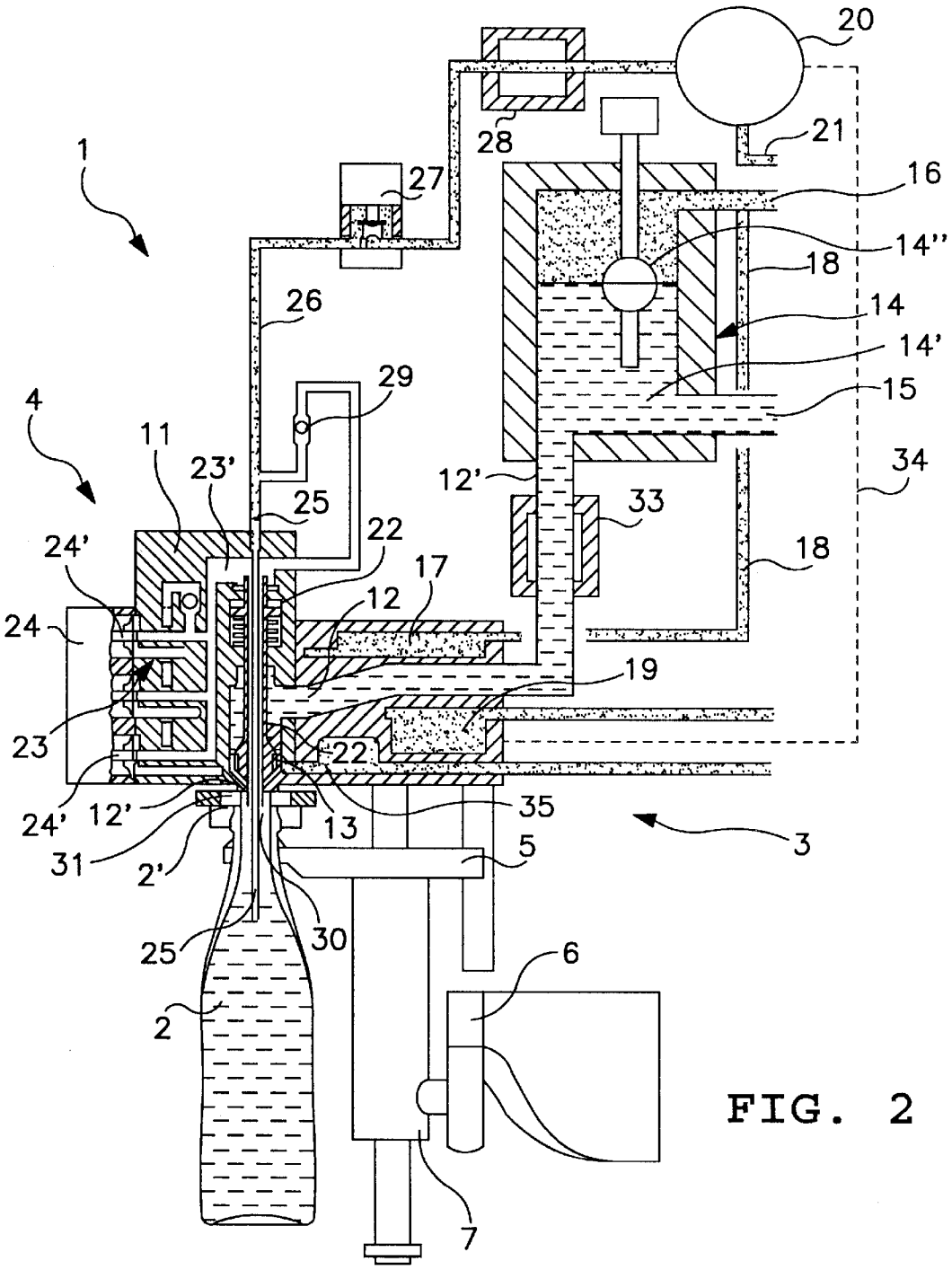
FIG. 2: in simplified manner the illustration of a filling device of the filling machine of FIG. 1.

So as to carry out the mentioned process steps, the filling machine 1, in the illustrated embodiment, has a configuration which is shown in greater detail in FIG. 2 for a filling device 4. The filling device 4—which does not comprise a filling tube or pipe—has a fluid channel 12 in a housing 11, which fluid channel includes a fluid valve; this valve being opened and closed, opened for the commencement of the actual filling phase, and closed at the completion of the filling phase.

The fluid channel 12 is in communication, specifically, by way of a conduit 12', with an annular boiler 14 provided at the rotor 3 or, respectively, with the filling material compartment 14' which is occupied by the filling material. Above the filling material compartment 14', there is provided, in the annular boiler 14, a gas compartment 14", this compartment containing carbon dioxide gas that is not subjected to a pressure, that is, carbon dioxide gas at atmospheric pressure, or very close to atmospheric pressure. The filling material compartment 14" is supplied with liquid filling material by way of conduit 15. The liquid level of the filling material is maintained at a predetermined level. The gas compartment 14" is supplied with carbon dioxide gas at atmospheric pressure by way of a conduit 16.

For carrying out the individual treatment steps, or process steps, there are further contemplated at the rotor 3, in the illustrated embodiment for all filling devices 4:

a carbon dioxide annular channel 17 which is connected, by means of a conduit 18, with the conduit 16 or, respectively, with the gas compartment 14", a return gas annular channel 19 which serves to achieve predepressurization and in which is controlled a pressure corresponding to the predepressurization pressure, an annular channel 20 which is supplied with carbon dioxide gas having a predetermined pressure, by way of a conduit 21 from a carbon dioxide gas source, not shown in detail, with the predetermined pressure of the carbon dioxide gas being greater than a saturation pressure, an annular channel 35 for the final depressurization.

Each filling device 4 has, furthermore, a return gas tube or pipe 22 which reaches, when the bottle 2 is operatively connected at the filling device 4, with its lower, open, end into the interior of the bottle 2 and reaches with its upper, open, end into a gas channel 23' which is configured in housing 11, which gas channel is a component of further gas paths which are configured in housing 11 and which are generally identified by reference numeral 23 in FIG. 2. The return gas tube 22 is surrounded at the lower side of the housing 11 by the annular fluid opening 12" of the fluid channel 12 which (fluid opening), when considered in the direction of flow of the filling material, is next to fluid valve 13. The gas paths 23 are controllable, by way of a control valve apparatus 24, one each for each filling device 4 and individually controllable, and this control is such that communication can be achieved for the interior space of a bottle 2—positioned in operative and sealing attitude at a pertaining filling device 4—with the mouth 2' of the bottle for the individual process steps or treatment steps, inter alia, also with the annular channel 17, 19 or, respectively, 20 pertaining to a process step, as will be described in greater detail below. The control valve apparatus 24, in the illustrated embodiment, comprises three individually controllable control valves 24' which control the interior gas paths 23 in suitable manner, that is, particularly the opening and the closing thereof.

Each filling device 4, furthermore, has a carbonation tube or pipe 25 which is arranged within the return gas tube 22 and particularly in axis parallel manner, such that the carbonation tube 25 projects with its lower, open, end a relatively large distance beyond the lower, open, end of the return gas tube 22. The upper end of the carbonation tube 25 is passed in a sealing manner through the gas compartment or, respectively, the gas channel 23', and it is connected, via conduit 26, with the annular channel 20. In conduit 26 are arranged control valves 27, specifically one for each filling device 4, as well as a volume or quantity measuring apparatus or element or device 28 which serves to measure, when the control valve 27 is in the open position, the amount of carbon dioxide gas which flows through the conduit 26 and which exists at the lower, open, end of the carbonation tube 25. Communication is established between the conduit 26 and the gas channel 23' by means of a check valve 29 and, in particular, when considered in the direction of flow of the carbon dioxide flowing through the conduit 26 and exiting at the lower end of the carbonation tube 25, behind the control valve 27. The check valve 29, furthermore, is configured in such a way that it opens for a gas flow from the conduit 26 into the gas channel 23', but closes for a gas flow in the opposite direction.

An annular return gas channel 30 which is open at the lower end of the return gas tube 22 and which joins the gas channel 23' at the upper end of the return gas tube is formed between the inner diameter of the return gas tube 22 and the outer diameter of the carbonation tube 25.

Considered individually, the described embodiment is capable of performing the following method steps during filling of a bottle 2, whereby the filling machine 1, prior to filling, of course, is supplied with all media necessary for filling (filling material and carbon dioxide gas in the annular boiler 14, as well as carbon dioxide gas under pressure in the annular channel 20).

1. Purging with Carbon Dioxide

After raising of the corresponding bottle 2 to be positioned against the filling device 4 this bottle is positioned in the end with its bottle mouth 2' in sealed manner against the lower side of the filling device 4 or, respectively, against a seal 31 present thereat and this is realized in such a manner that the return gas tube 22 and the carbonation tube 25 reach through the bottle mouth 2' into the interior of the bottle 2 and that the interior space of the bottle 2 is also in communication with the annular fluid opening 12" of the fluid channel 12, which opening is provided, when considered in the direction of flow, behind the fluid valve 13. The fluid valve 13 is in the closed position.

For commencement of the purging process the control valve 27 is opened and, simultaneously, the control valve apparatus 24 is controlled in such a way that by way of this apparatus that part of the fluid channel 12, which is formed, when considered in the direction of flow, beneath the fluid valve 13, is in communication with the annular channel 19. By way of the open valve 27, accordingly, carbon dioxide gas flows into the carbonation tube 25 and it exits at the lower end of this tube, which end reaches deep into the bottle, in the manner of rays in the direction of the bottom of the bottle; and thus displaces, accordingly, commencing at the bottom, the air present in the bottle 2 which air is passed, via annular opening 12", in the direction of arrow 41 from the bottle into the channel 19. A certain amount of carbon dioxide gas reaches, via the check valve 29, also the gas channel 23', from there into the return gas channel 30, and flows, via the lower open end of the gas channel, also into the interior of the bottle and contributes to the displacement of air from the bottle 2.

This purging process is continued for a time sufficient to establish the desired inert gas atmosphere in the bottle 2. The duration of the purging process is, for example, determined by a time control apparatus.

2. Filling of Bottle 2 with Non-carbonated Filling Material

When the valve 27 has closed again and in the condition when the control valve apparatus 24 has severed the communication between the lower end of the fluid channel 12 and the annular channel 19, filling of the bottle 2 with the liquid filling material is carried out.

For this, via the control valve apparatus 24, the gas channel 23' is brought to be in communication with the annular channel 17, such that in the bottle the pressure of the gas compartment 14" is present, that is, in the illustrated embodiment, the atmospheric pressure is present. Subsequently, the fluid valve 13 is brought to the open condition such that the filling material flows, via the annular opening 12" along the interior surface of the bottle 2 into the interior space of the bottle. As soon as the preset filling volume has been attained, the fluid valve 13 is closed. Parallel hereto, by way of the control valve apparatus 24, the communication to the annular channel 17 is severed. In the illustrated embodiment a volume measuring apparatus 33 is contemplated for control of the preset filling quantity or volume, in the conduit 12', which provides communication between the annular boiler 14 and the fluid channel 12.

Upon attainment of the preset filling height, the liquid level of the filling material in the bottle 2 is beneath the lower opening of the gas channel 30, but far above the lower end of the carbonation tube 25.

3. Pre-pressurization of the Filled Bottle

So as to be able to achieve carbonation of the liquid filling material in a subsequent method step, first there is done a prepressurization of the filled bottle using carbon dioxide gas. For this, via control valve apparatus 24, the gas channel 23', via a conduit 34, is brought to be in communication with the annular channel 20—which conducts the carbon dioxide under pressure. By way of the return gas channel 30, the carbon dioxide gas reaches, during this prepressurization, into the headspace of the pertaining bottle 2 formed above the level of thee filling material, which headspace is not occupied by the filling material.

By way of means not shown, the prepressurization pressure is adjusted in the conduit 34 in such a manner that during prepressurization the pressure in the bottle is raised to such a level of pressure which is in the range of the saturation pressure. The volume of gas necessary for prepressurization is rather small, since the headspace of a corresponding bottle 2 comprises a relatively small volume and only this headspace needs to be filled with the pressurizing gas and needs to be brought to the pressurization pressure or, respectively, the saturation pressure.

Development of foam in the subsequent carbonation is precluded by means of the prepressurization of the bottle 2. When the filling material or the beverage has only a small affinity to foam development and/or if in the subsequent carbonation step only a low carbon dioxide content is to be established, the prepressurization may be omitted as a matter of principle.

4. Carbonating the Filling Material

A carbon dioxide pressure is maintained in annular channel 20 which is markedly above the saturation pressure, that is, above that outer pressure in which the desired amount of carbon dioxide gas is dissolved in the finished beverage. For carbonation of the filling material filled into the corresponding bottle, the control valve 27 is opened such that, via the carbonation tube 25, carbon dioxide gas under pressure flows in the manner of rays into the filling material. Because of its relatively large length, the carbonation tube 25 is deeply submerged in the filling material. The desired degree of carbonation or, respectively, the desired amount of carbon dioxide gas introduced during carbonation, in the illustrated embodiment, is controlled by a volume measuring apparatus or element 28. As a matter of principle, it is also possible to utilize a time control, or a combination of time control and mass measuring or volume measuring.

During carbonation the pressure in the bottle rises markedly to a level above the saturation pressure. Under these conditions, the filling material immediately absorbs the carbon dioxide.

5. Calming and Predepressurization

Upon conclusion of the carbonation phase, control valve 27 is closed. By way of the control valve apparatus 24 the gas channel 23' and, accordingly, the interior space of the bottle is brought into communication with the annular channel 19, such that the pressure in the bottle 2 is lowered, in throttled manner, to a controlled pressure which is markedly below the carbon dioxide saturation pressure in the filling material or, respectively, the beverage. At this pressure level there is carried out a calming of the filling material which calming is limited as to time. Gas bubbles still remaining in the filling material rise to the surface without significant foam development.

So as to preclude that carbon dioxide gas—still present in the interior of the carbonation tube 25 due to the carbonation step, and which gas expands during calming and predepressurization—leaves the lower end of the carbonation tube 25 as gas bubbles, which would lead to a disturbance, or to over-foaming of the filling material, the carbonation tube 25 is in communication, via check valve 29, with the gas channel 23', such that any residual carbon dioxide gas is also removed from the carbonation tube 25, via gas channel 23' and the control valve apparatus 24, into the annular channel 19. During the carbonation phase, the pressure in the carbonation tube 25 is significantly greater than the gas pressure in the headspace of the bottle or, respectively, in the gas channel 30 and the gas compartment 23', such that the check valve 29 is closed during the carbonation process. Only upon conclusion of the carbonation process, that is, after closing of the valve 27, there is achieved, between the carbonation tube 25 and the head space of the bottle, an equal pressure, such that during the predepressurization phase and the calming phase, the pressures in the carbonation tube 25 and in the headspace of the bottle 2, with the check valve 29 being open, can be reduced in parallel manner, and, particularly, for avoiding a damaging emission of gas from the carbonation tube 25, as has been described in the foregoing.

6. Final Depressurization

Just prior removal of the corresponding bottle 2 from a filling device 4, by way of the control valve apparatus 24, the interior space of the bottle is de-aerated either to the atmosphere, or via the annular channel 35 which is common to all filling devices 4 and which channel is in communication with the atmosphere. In the gas path which is provided for this final depressurization is disposed, preferably, a throttle element, for example, a nozzle with a predetermined flow cross-section, such that the inner pressure of the bottle is lowered in controlled manner to the atmospheric pressure.

The additional process time that is required for carbonation can be compensated with an acceleration of the filling in the preceding filling step and, particularly thereby that in comparison to carbon dioxide containing products, the filling with quiet products or beverages can be carried out more rapidly and, accordingly, in a shorter period of time. The filling machine 1, accordingly, can be dimensioned at the same filling capacity in the order of magnitude as is customary nowadays, and with the advantage that separate carbonation equipment is superfluous.

The invention has been described in the foregoing on the basis of one embodiment. It will be clear that numerous modifications and variations are within the scope of the invention and without departing from the fundamental thought that underlies the invention. Thus, is it is possible, for prepressurization of the corresponding bottle 2 to the prepressurization pressure or, respectively, the saturation pressure, to arrange an additional annular channel which conducts the carbon dioxide gas at the saturation pressure and which is common to all filling devices 4. Furthermore, it is, of course, possible to carry out the prepressurization of the bottles 2 to the prepressurization pressure or, respectively, the saturation pressure, prior to carrying out the filling step, whereby the gas compartment 14' of the annular boiler 14 contains the carbon dioxide gas that is at prepressurization pressure or, respectively, saturation pressure. The described embodiment, in which prepressurization is carried out after the filling phase has the advantage that only minor amounts of carbon dioxide gas are necessary for the prepressurization, as has been described above.

One feature of the invention resides broadly in the method of filling bottles, cans, or the like containers 2, with a liquid filling material using a filling machine 1 having a plurality of filling positions, each comprising a filling device 4 at which the container 2, at least during a portion of the filling process, is operatively connected in sealed manner with a container mouth 2', and via which filling device 4 the interior space of the container, in a filling phase, is in controlled manner filled with liquid filling material, and in at least one process step is impacted with a carbon dioxide gas under pressure, characterized thereby that the liquid filling material in the corresponding container 2 is mixed with carbon dioxide or, respectively, carbonated, by introduction of the carbon dioxide gas under pressure.

Another feature of the invention resides broadly in the method characterized thereby that the carbonation of the filling material is carried out after completion of the filling phase in the container 2.

Yet another feature of the invention resides broadly in the method characterized thereby that filling material which is introduced into the container 2 during the filling phase is one of: a product without carbon dioxide content, or a product with a carbon dioxide content that is substantially below the level of the carbon dioxide content of the filled filling material.

Still another feature of the invention resides broadly in the method characterized thereby that carbonation of the filling material in the container 2 is carried out by means of at least one gas opening which is submerged in the liquid filling material and by way of introduction of the carbon dioxide gas under pressure.

A further feature of the invention resides broadly in the method characterized thereby that the carbonation of the filling material is carried out by way of a carbonation tube 25 which is immersed by a predetermined distance beneath the liquid level of the filling material with its lower end that provides the gas opening, through the opening 21 of the container, in the liquid filling material.

Another feature of the invention resides broadly in the method characterized thereby that prior to carbonation of the liquid filling material there is carried out a prepressurization of the container 2 to a prepressurization pressure or, respectively, a saturation pressure.

Yet another feature of the invention resides broadly in the method characterized thereby that the prepressurization of the container is carried out in a prepressurization phase that precedes the filling phase.

Still another feature resides broadly in the method characterized thereby that the prepressurization of the container is carried out after the filling phase. A further feature of the invention resides broadly in the method characterized thereby that for carbonation the carbon dioxide gas is introduced into the liquid filling material with a pressure which is markedly above the prepressurization pressure or the saturation pressure.

Another feature of the invention resides broadly in the method characterized thereby that the corresponding container 2, prior to carbonation, is prepressurized to a prepressurization pressure or a saturation pressure. Yet another feature of the invention resides broadly in the method characterized thereby that the interior space of the container 2 is purged with an inert gas in a process step that precedes the filling phase.

Still another feature of the invention resides broadly in the method characterized thereby that the purging is carried out with the inert gas or carbon dioxide gas via the carbonation tube 25.

A further feature of the invention resides broadly in the method characterized thereby that the filling of the container 2 is carried out under atmospheric pressure during the filling phase.

Another feature of the invention resides broadly in the method characterized thereby that the filling of the container 2 is carried out during the filling phase under counter-pressure.

Yet another feature of the invention resides broadly in the method characterized thereby that the depressurization of the container to atmospheric pressure is done after carbonation.

Still another feature of the invention resides broadly in the method characterized thereby that the depressurization to atmospheric pressure is done in at least two steps and, particularly, initially a pre-depressurization to a pre-depressurization pressure that is above the atmospheric pressure, and subsequently a final depressurization to the atmospheric pressure.

A further feature of the invention resides broadly in the method characterized thereby that between the depressurization to the predepressurization pressure and the final depressurization there is provided a calming phase.

Another feature of the invention resides broadly in the method characterized thereby that after carbonation and during depressurization there is done a depressurization also of the interior space of the carbonation tube 25.

Yet another feature of the present invention resides broadly in the filling machine for filling bottles, cans, or the like containers 2, with a liquid filling material, with a plurality of filling positions, each of which comprises a filling device 4 at which the corresponding container 2, at least during a portion of a filling process, is operatively connected with a container mouth 2' in sealed manner and by way of which filling device the interior space of the container, in a filling phase and in controlled manner, is filled with the liquid filling material and is impacted in at least one method step with a carbon dioxide gas under pressure, characterized by means 25 for carbonation of the liquid filling material in the corresponding container 2 by introduction of the carbon dioxide gas under pressure into the filling material.

Still another feature of the invention resides broadly in the filling machine characterized by at least one gas opening at the filling device which is immersed in the liquid filling material and via which the carbonation of the filling material in the container 2 is carried out by introduction of the carbon dioxide gas under pressure.

A further feature of the invention resides broadly in the filling machine characterized by a carbonation tube 25 which forms the gas opening with a lower end and which projects beyond the lower end of the filling device 4.

Another feature of the invention resides broadly in the filling machine characterized thereby that the filling devices 4 are those that do not have a filling tube.

Yet another feature of the invention resides broadly in the filling machine characterized thereby that the carbonation tube 25 projects from an opening of a return gas channel 30 beyond the lower side of the filling device 4.

Figure 3:
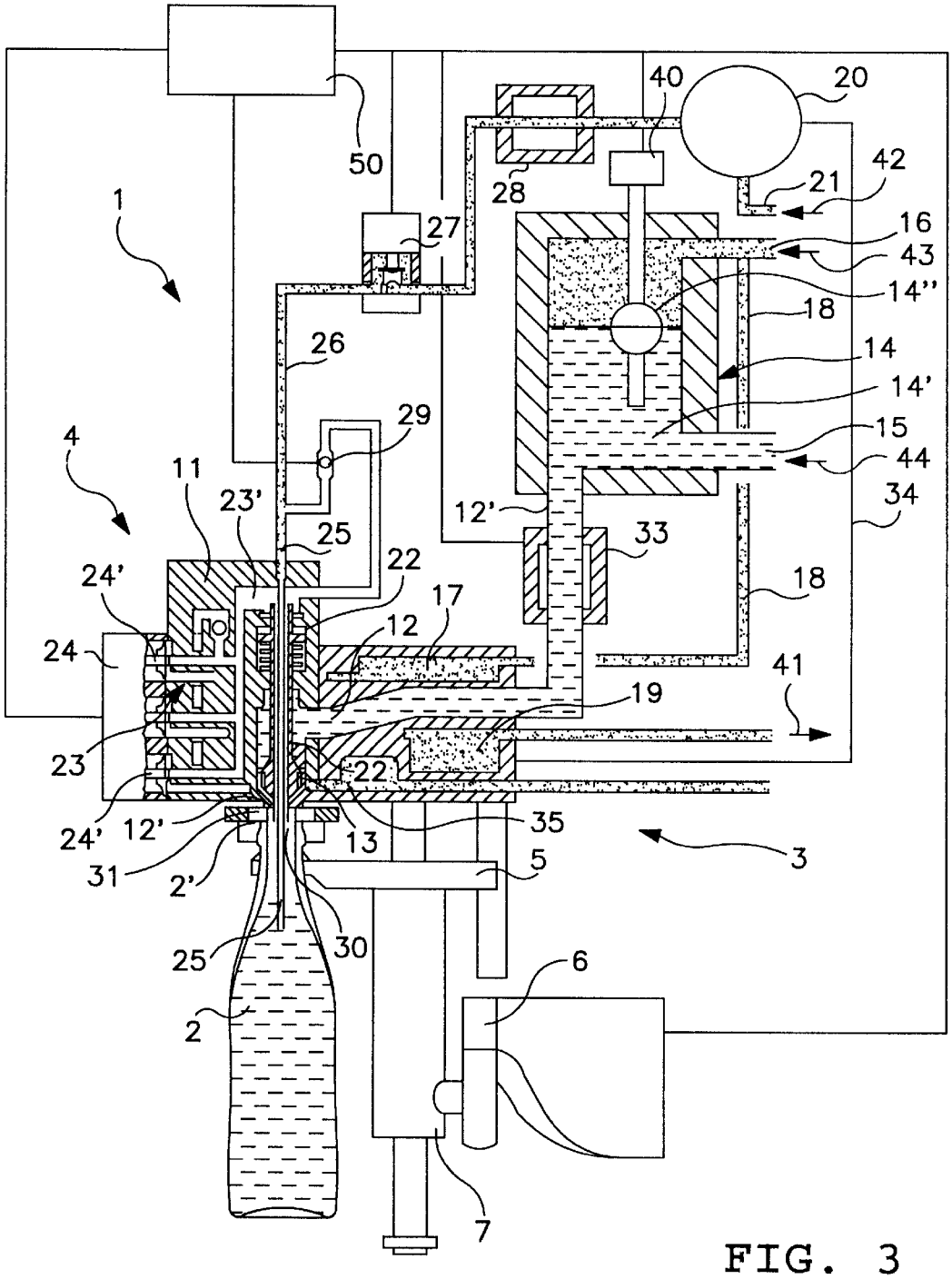
FIG. 3: is a similar diagram as FIG. 2, and showing additional details.

FIG. 3 illustrates the control of the system using a central process control arrangement, generally identified by reference numeral 50. This process control 50 is linked, inter alia, to the control valve apparatus 24, the control valve 27, the check valve 29, the volume or quantity measuring element or device 28, and a level monitor/control device 40. Similarly, the process control 50 supervises the raising and lowering of the container carrier 5 and the supply of non-carbonated liquid beverage filling material, as well as the supply of carbon dioxide for purging and for carbonating.

Carbon dioxide gas is passed in the direction of arrow 42 from a source of carbon dioxide, not shown, through conduit 21 to annular channel 20 to supply carbon dioxide with a pressure above the saturation pressure.

The gas compartment 14" is supplied with carbon dioxide gas at atmospheric pressure from a source, not shown, in the direction of arrow 43 through conduit 16.

Non-carbonated liquid filling material is passed from a source or supply, not shown, in the direction of arrow 44 through conduit 15 into the filling material compartment 14'.

Figure 4:
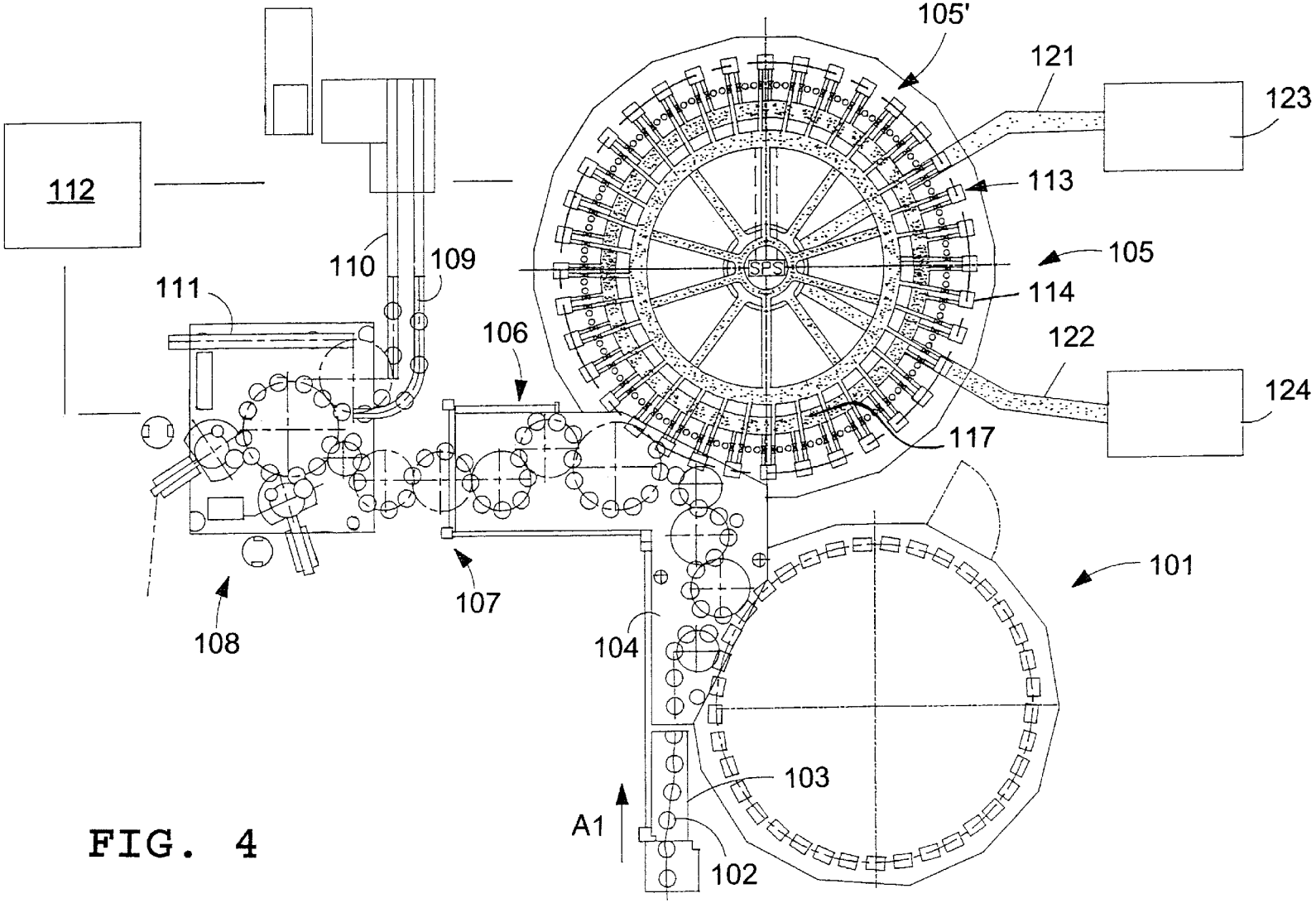
FIG. 4: is a simplified overhead view of a system or equipment for the simultaneous filling, closing and subsequent labelling of containers, namely bottles.

FIG. 4 shows one example of a system for filling containers which could possibly utilize the present invention. FIG. 4 shows a rinser 101, to which the containers, namely bottles 102, are fed in the direction indicated by the arrow A, by means of a conveyor line 103, and downstream of which, in the direction of travel, the rinsed bottles 102 are transported by means of a conveyor line 104 formed by a star wheel conveyor to a filling machine 105 or its inlet star wheel. Downstream of the filling machine 105, in the direction of travel of the bottles 102, there can preferably be a closer 106 which closes the bottles 102. The closer 106 can be connected directly to a labeling device 108 by means of a conveyor line 107 formed by a plurality of star wheel conveyors. In the illustrated embodiment, the labelling device 108 has three outputs, namely one output formed by a conveyor 109 for bottles 102 which are filled with a first product, from product mixer 123 through conduit 121 and are then labelled corresponding to this product, a second output formed by a conveyor 110 for those bottles 102 which are filled with a second product from product mixer 124 through conduit 122 and are then labelled corresponding to this product, and a third output formed by a conveyor 111 which removes any bottles 102 which have been incorrectly labeled.

In FIG. 4, 112 is a central control unit or, expressed differently, controller or system which includes a process controller which, among other things, controls the operation of the above-referenced system.

The filling machine 105 is preferably of the revolving design, with a rotor 105' which revolves around a vertical machine axis. On the periphery of the rotor 105' there are a number of filling positions 113, each of which consists of bottle carriers or container carriers (not shown, but compare element 5 in FIGS. 3 and 4), as well as a filling device 114 located above the corresponding container carrier. The toroidal vessel 117 is a component of the revolving rotor 105'. The toroidal vessel 117 can be connected by means of a rotary coupling and by means of an external connecting line 121 to an external reservoir or mixer 123 to supply the product, that is, product mix 1, for example.

As well as the more typical filling machines having one toroidal vessel, it is possible that in at least one possible embodiment of the present invention a filling machine could possibly be utilized wherein each filling device 114 is preferably connected by means of two connections to a toroidal vessel 117 which contains a first product (by means of a first connection, for example, 121) and to a second toroidal vessel which contains a second product (by means of the second connection, for example, 122). In this case, each filling device 114 can also preferably have, at the connections, two individually-controllable fluid or control valves, so that in each bottle 102 which is delivered at the inlet of the filling machine 105 to a filling position 113, the first product or the second product can be filled by means of an appropriate control of the filling product or fluid valves.

It will be understood that while a two-product assembly is illustrated in FIG. 4, that the invention is equally applicable to single-product installations, or other commensurate embodiments.

Figure 5:
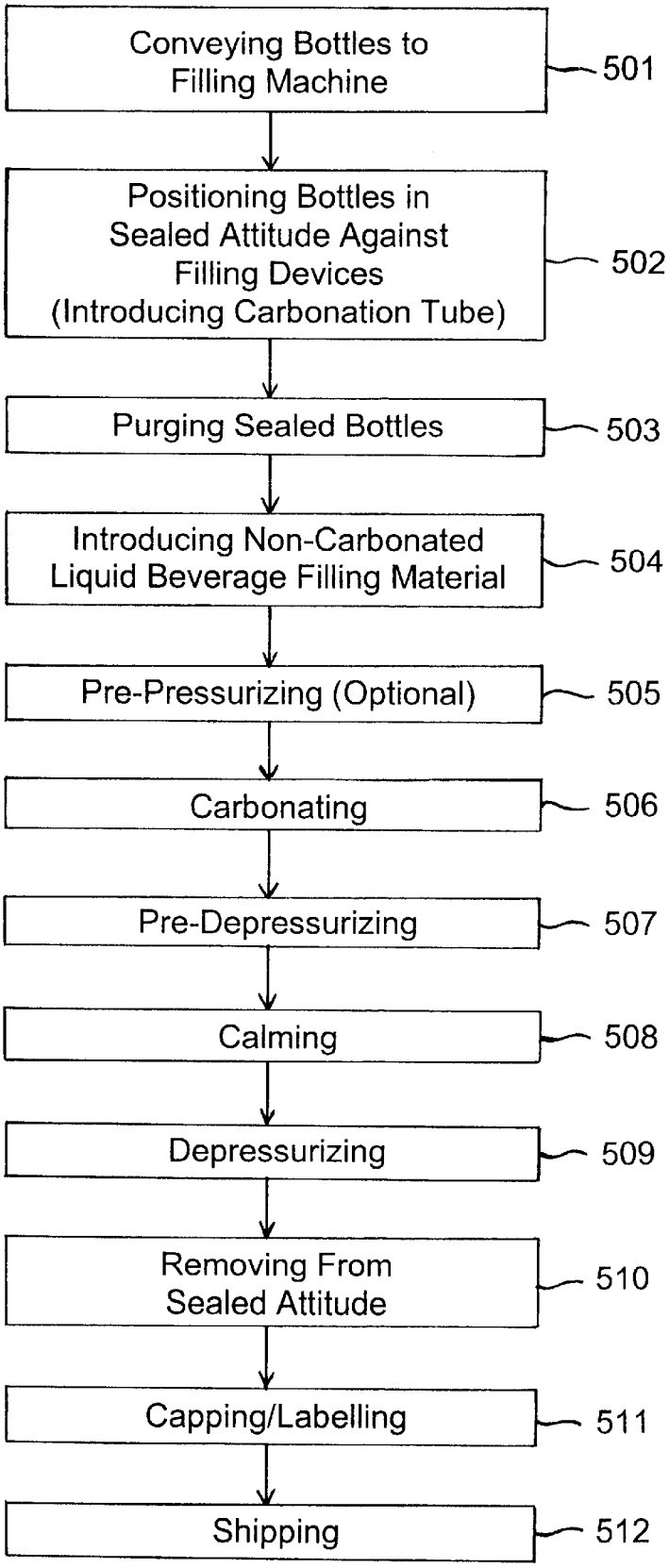
FIG. 5: is s simplified block flow diagram of a method in accordance with one aspect of the invention.

FIG. 5 illustrates a possible method embodiment of the invention, said method comprising step 501 in which bottles are conveyed to or into the filling machine. In step 502 the bottles are positioned so as to be sealed against filling devices and purging, using a carbon dioxide gas, for example, is carried out in step 503. The invention contemplates that a non-carbonated liquid beverage filling material is introduced in step 504. This may be followed by an optional pre-pressurizing step 505. Carbonating is then carried out in step 506 for a period of time and with a pressure sufficient to reach saturation of the filling material with carbon dioxide. The carbonating step is followed by such steps as pre-depressurizing 507, calming 508, and depressurizing to the final pressure, step 509. The bottles are then removed from the sealed attitude from the filling devices, step 510, and passed to capping, step 511, which is followed by preparing for shipping, step 512.

Figure 6:
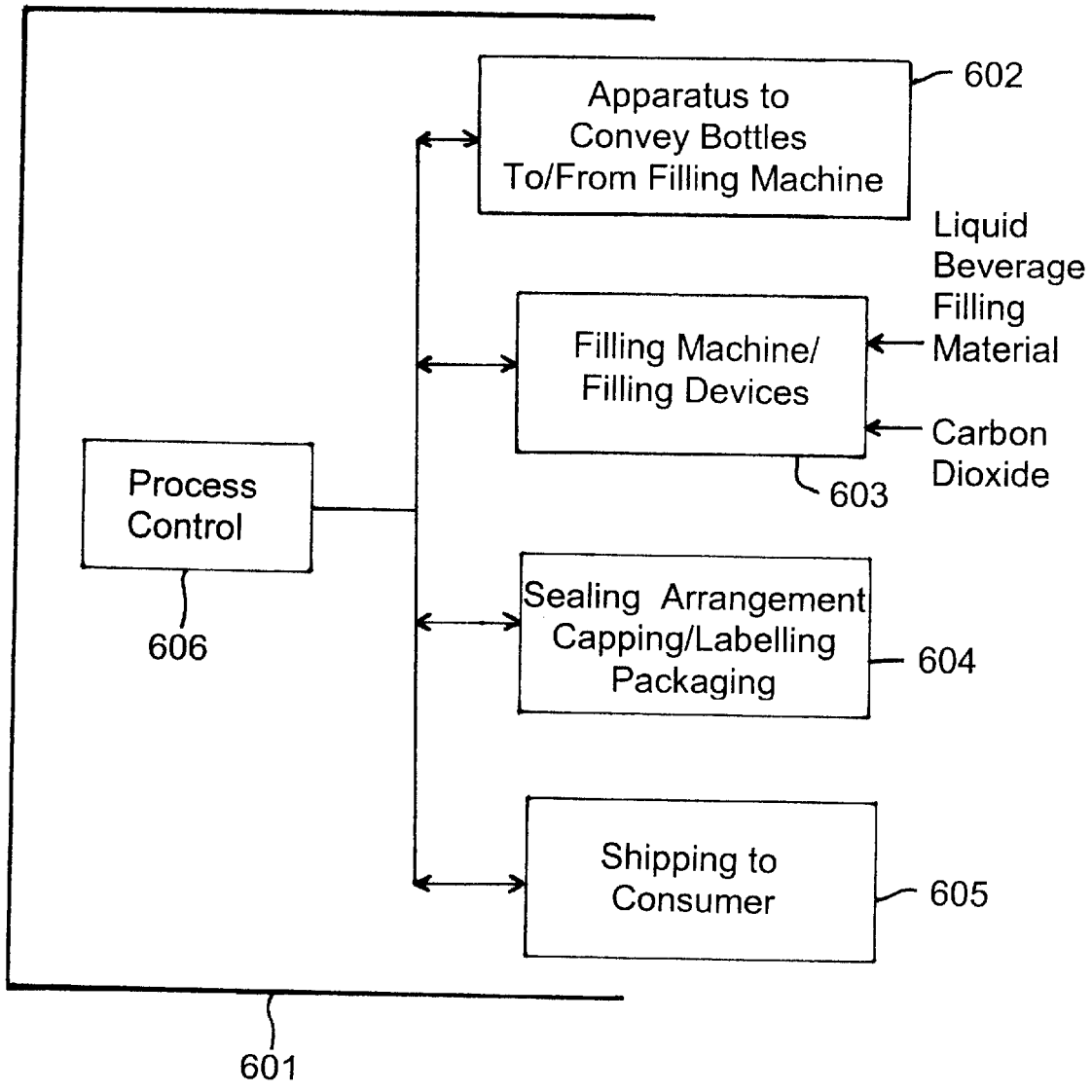
FIG. 6: is a diagram of a plant for filling and further processing of containers.

FIG. 6 illustrates schematically a plant 601 for filling, and shipping beverage containers, such as bottles or cans. Thus, there is a provided apparatus 602 to convey bottles or cans to and from a filling machine 603. The filling machine 603 fills the bottles or cans to a predetermined height and carbonates the content to the specified extent. The containers are then passed to capping/sealing in the sealing arrangement 604 which may be followed by labelling and packaging. The packaged product is supplied to shipping to consumers by equipment generally identified by reference numeral 605. The equipment operates under process control from the control arrangement generally identified by reference numeral 606.

A further feature of the invention resides broadly in a method of operating a plant for filling beverage containers, such as beverage bottles and beverage cans, with liquid beverage filling material using a beverage filling machine having a plurality of beverage filling positions, each filling position comprising a beverage filling device for filling a beverage container, each filling device comprising a return gas tube and a carbonation tube, said method comprising the steps of: moving a beverage container to be filled in sequence with other containers to said filling machine; elevating said beverage container to be filled to a corresponding filling device thereby introducing a corresponding return gas tube and a corresponding carbonation tube of said beverage filling device through the mouth of said beverage container into the interior of said beverage container, and positioning said carbonation tube deeper into said beverage container than said return gas tube; sealing said beverage container to be filled against the corresponding filling device; purging said sealed beverage container by introducing a carbon dioxide containing gas into the interior of said sealed beverage container by way of said carbonation tube, to thereby displace residual air present out of said sealed beverage container; terminating said step of purging with a carbon dioxide containing gas; at the end of said purging step, introducing a flow of a predetermined volume of non-carbonated liquid beverage filling material into the interior of said sealed beverage container with a filling device without adding additional carbon dioxide gas; terminating the step of flowing non-carbonated liquid beverage filling material into the interior of said sealed beverage container; introducing a predetermined quantity of carbon dioxide gas through said carbonation tube into the liquid beverage filling material present in said sealed beverage container, in a sufficient quantity with a sufficient pressure to effect carbonation with a sufficient saturation of said liquid beverage filling material in said sealed beverage container to absorb carbon dioxide in said liquid beverage filling material, at a pressure level above the saturation pressure sufficient to produce a carbonated beverage; terminating the step of introducing carbon dioxide gas; calming the carbonated beverage filling material in said sealed beverage container for a predetermined period of time to attain a pressure markedly below the carbon dioxide saturation pressure and thus removing excess gas bubbles; reducing the gas pressure in said sealed beverage container to a final pressure; distancing said filled beverage container filled with carbonated liquid beverage from the sealing relationship with the corresponding filling device; and removing said filled beverage container from said filling machine.

Examples of apparatus and procedures to measure carbon dioxide ($CO_2$) content or concentration and which may possibly be incorporated in embodiments of the present invention may be found in: U.S. Pat. No. 4,801,551 issued to Byers et al. on Jan. 31, 1989 and entitled "Rugged dissolved carbon dioxide monitor for high purity water"; U.S. Pat. No. 5,029,103 issued to Carbide on Jul. 2, 1991 and entitled "Carbon dioxide monitor"; U.S. Pat. No. 5,068,090 issued to Connolly on Nov. 26, 1991 and entitled "Aqueous carbon dioxide monitor"; and U.S. Pat. No. 5,252,491 issued to Connolly on Oct. 12, 1993 and entitled "Aqueous carbon dioxide monitor", all of these U.S. patents being hereby expressly incorporated by reference as if set forth in their entirety herein.

Examples of apparatus and methods for sensing or measuring temperature parameters and which may possibly be utilized in connection with the present invention are to be found in: U.S. Pat. No. 4,038,873 issued to Kimmel on Aug. 2, 1977 and entitled "Temperature monitor and indicator"; U.S. Pat. No. 4,278,841 issued to Regennitter et al. on Jul. 14, 1981 and entitled "Multiple station temperature monitor system"; U.S. Pat. No. 4,623,265 issued to Poyser on Nov. 18, 1986 and entitled "Transformer hot-spot temperature monitor"; U.S. Pat. No. 4,802,772 issued to Chianese on Feb. 7, 1989 and entitled "Nonelectric temperature monitor"; U.S. Pat. No. 5,469,855 issued to Pompei et al. on Nov. 28, 1995 and entitled "Continuous temperature monitor"; U.S. Pat. No. 5,511,415 issued to Nair et al. on Apr. 30, 1996 and entitled "Gas flow and temperature probe and gas flow and temperature monitor system including one or more such probes"; U.S. Pat. No. 5,531,191 issued to Davis on Jul. 2, 1996 and entitled "Fluid temperature monitor"; U.S. Pat. No. 5,563,239 issued to Pompei et al. on Aug. 5, 1997 and entitled "Continuous temperature monitor"; U.S. Pat. No. 5,662,419 issued to Lamagna on Sep. 2, 1997 and entitled "Time-temperature monitor and recording device and method for using the same"; U.S. Pat. No. 5,708,412 issued to Proulx on Jan. 13, 1998 and entitled "Fluid level and temperature monitor and alarm system"; and U.S. Pat. No. 5,890,100 issued on Mar. 30, 1999 to Crayford and entitled "Chip temperature monitor using delay lines", all of these U.S. patents being hereby expressly incorporated by reference as if set forth in their entirety herein.

Examples of apparatus and methods for determining parameters such as the filling volume, the empty volume, and the filling height which may possibly be utilized in embodiments of the present invention may be found in: U.S. Pat. No. 4,134,407 issued to Elam on Jan. 16, 1979 and entitled "External pressure-volume monitor"; U.S. Pat. No. 4,282,757 issued to Cohn on Aug. 11, 1981 and entitled "Device for detecting rate of change in pressure"; U.S. Pat. No. 4,391,412 issued to Goldhammer on Jul. 5, 1983 and entitled "Apparatus for limiting filling height of containers"; U.S. Pat. No. 4,765,342 issued to Urman et al. on Aug. 23, 1988 and entitled "Timed drift compensation for rate volume monitor"; U.S. Pat. No. 4,788,456 issued to Urman et al. on Nov. 29, 1988 and entitled "Variable threshold for rate volume monitor"; U.S. Pat. No. 4,928,687 issued to Lampotang et al. on May 29, 1990 and entitled "$CO_2$ diagnostic monitor"; U.S. Pat. No. 5,008,653 issued to Kidd et al. on Apr. 16, 1991 and entitled "Fluid detector with overfill probe"; U.S. Pat. No. 5,110,208 issued to Sreepada et al. on May 5, 1992 and entitled "Measurement of average density and relative volumes in a dispersed two-phase fluid"; U.S. Pat. No. 5,244,550 issued to Inoue on Sep. 14, 1993 and entitled "Two liquid separating methods and apparatuses for implementing them"; U.S. Pat. No. 5,279,157 issued to Mattis et al. on Jan. 18, 1994 and entitled "Liquid level monitor"; and U.S. Pat. No. 6,099,470 issued to Bahr on Aug. 8, 2000 and entitled "Monitor for diffusable chemical substance", all of these U.S. patents being hereby expressly incorporated by reference as if set forth in their entirety herein.

Examples of apparatus and/or methods which may possibly be incorporated in a possible embodiment of the present invention that may possibly work under the control of pneumatic pressure may be found in: U.S. Pat. No. 4,044,732 issued to Inada et al. on Aug. 30, 1977 and entitled "Pneumatic control system and pressure responsive valve assembly therefor"; U.S. Pat. No. 4,576,194 issued to Lucas et al. on Mar. 18, 1986 and entitled "Pneumatic control system, control means therefor and method of making the same"; U.S. Pat. No. 4,679,583 issued to Lucas et al. on Jul. 14, 1987 and entitled "Pneumatic control system, control means therefor and method of making the same"; U.S. Pat. No. Re 34,202 issued to Kautz on Mar. 30, 1993 and entitled "Dual mode pneumatic control system"; U.S. Pat. No. 5,642,271 issued to Henderson on Jun. 24, 1997 and entitled "Pneumatic control system"; U.S. Pat. No. 5,816,132 issued to Langner et al. on Oct. 6, 1998 and entitled "Load-sensing pneumatic control system"; and U.S. Pat. No. 6,129,002 issued to Lisec et al. on Oct. 10, 2000 and entitled "Valve arrangement, especially for a pneumatic control system", all of these U.S. patents being hereby expressly incorporated by reference as if set forth in their entirety herein.

Examples of apparatus and/or methods which may possibly be incorporated in a possible embodiment of the present invention that may possibly work under the control of hydraulic pressure may be found in: U.S. Pat. No. 5,513,551 issued to Morishita on May 7, 1996 and entitled "Hydraulic control system"; U.S. Pat. No. 5,579,642 issued to Wilke et al. on Dec. 3, 1996 and entitled "Pressure compensating hydraulic control system"; U.S. Pat. No. 5,718,115 issued to Burkner on Feb. 17, 1998 and entitled "Constant force hydraulic control System"; U.S. Pat. No. 5,758,499 issued to Sugiyama et al. on Jun. 2, 1998 and entitled "Hydraulic control system"; U.S. Pat. No. 5,832,729 issued to Reid et al. on Nov. 10, 1998 and entitled "Hydraulic control system"; U.S. Pat. No. 5,921,165 issued to Takahashi et al. on Jul. 13, 1999 and entitled "Hydraulic control system"; and U.S. Pat. No. 6,062,331 issued to Grunow et al. on May 16, 2000 and entitled "Auxiliary hydraulic control system for a work machine", all of these U.S. patents being hereby expressly incorporated by reference as if set forth in their entirety herein.

The features disclosed in the various publications, disclosed or incorporated by reference herein, may be used in the embodiments of the present invention, as well as, equivalents thereof.

The appended drawings in their entirety, including all embodiments dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign and international patent publication applications, namely, Federal Republic of Germany Patent Application No. 100 28 676.3, filed on Jun. 9, 2000, having inventor Ludwig CLÜSSERATH, and DE-OS 100 28 676 and DE-PS 100 08 426, as well as their published equivalents, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

All of the references and documents, cited in any of the documents cited herein, are hereby incorporated by reference as if set forth in their entirety herein. All of these references and documents, referred to in the immediately preceding sentence, include all of the patents, patent applications and publications cited anywhere in the present application.

In the claims, means-plus-function clauses are intended to cover the structures described herein as performing the recited function and not only structural equivalents but also equivalent structures.

While the invention has other applicability, the present invention has most applicability in machinery of KHS Maschinen- und Anlagenbau Aktiengesellschaft of Dortmund, Federal Republic of Germany, and such machinery may be viewed on the company's website under www.khs-ag.de, particularly under www.khs-ag.de/en/05products/lmachines.

The website shows aspects of cleaning technology (INNOCLEAN), namely, single-end bottle washers of which there are three versions of the INNOCLEAN single-end bottle washer. The machines offered range from the lowest capacity (INNOCLEAN EC) with an output of 10,000 bottles per hour, the mid-capacity of 10,000 to 30,000 bottles per hour (INNOCLEAN EK), to machines with capacities for 150,000 bottles per hour (INNOCLEAN EE+INNOCLEAN EM, also available as multiple bath versions). All models have been designed for washing returnable and non-returnable glass and PET bottles. Double-end bottle washers: the INNOCLEAN DM double-end, multiple-bath bottle washer is designed for the mid to high capacity range of up to 150,000 bottles per hour. This machine fulfills the highest possible bottle requirements by consistently separating the impurities from the clean bottle discharge. Very long treatment periods can be achieved by combining a series of various types of caustic baths. The INNOCLEAN DM is available in various overall heights. The INNOCLEAN DMT product line machines are double-end bottle washers with modified automation. Crate washers: the INNOCLEAN KW is a fully automatic washing system for plastic crates. Made entirely of stainless steel, single or two-vat versions are available of these single and double-track machines. Capacities range from 500 to 10,000 crates per hour. Crates are washed by two optional types of high-pressure spraying: 1. hot water and follow-up spraying, 2. caustic spraying, hot water and follow-up spraying.

Washing and filling technology for kegs—INNOKEG: comprising keg washers and fillers—whether the INNOKEG RF-SU for the lower capacity range or the linear INNOKEG RF-MP and RF-DP (single and double-conveyor versions) for the mid and upper capacity range, the tried and tested INNOKEG RF product line is the center of attention of the KHS keg systems for the beverage industry. Keg interior cleaning, sterilization, and keg filling is performed fully automatically. Ideal for filling carbonated and non-carbonated beverages such as beer, soft drinks, mineral water, wine and fruit juices. Rotary fillers: the INNOKEG KR is continuous operation (rotary-type) keg treatment machine-filler. It is suitable for filling kegs and containers equipped with central fitting systems and ideal for filling carbonated and non-carbonated beverages such as beer, juice, mineral water, wine and fruit juices. The INNOKEG KR is available in four capacity ranges: up to 600 kegs per hour, filler with 16 filling elements; up to 800 kegs per hour, filler with 20 filling elements; up to 1,000 kegs per hour, filler with 24 filling elements. More than 1,000 kegs per hour, filler with 32 filling elements. Pre-treatment and checking: the INNOKEG product line offers several machine models for pre-treatment and checking of kegs: 1. the INNOKEG AR keg exterior washer, a completely covered tunnel machine for treatment of keg exteriors (capacity 60 to 1,200 kegs per hour); 2. the multiple head INNOKEG MK used for checking the condition of kegs such as cap stripper and check re-tightener, residual pressure check as well as optical distortion checking 70–1,100 kegs per hour capacity (depending on the equipment). Keg handling machines: KHS has a number of keg handling machines in its INNOKEG program: from protective cap cappers and decappers (INNOKEG PM-BK/PM-EK) to the keg program turner (INNOKEG PM-PW) for repositioning horizontally palletized kegs so that fittings point inward or outward. This product line is rounded off by the double-cross keg turner (INNOKEG PM-DW), the keg constant turner (INNOKEG PM-SW) which turns all kegs 180 degrees after filling, and the keg control turner (INNOKEG PM-KW).

Inspection technology (INNOCHECK): empty bottle inspectors: the INNOCHECK LF product line from KHS offers a wide variety of state-of-the-art devices and machines for inspecting returnable glass or PET packaging. Capacities range from 36,000 to 72,000 bottles per hour. High-tech camera technology and tried and tested sensory testing systems, among others, are implemented for the following methods of inspection: bottle height checking, sealing surface, IR residual liquids check, inner side walls, camera base. Foreign substance inspectors: the INNOCHECK FS is a highly dependable foreign substance inspector for inspecting PET multi-use bottles against contamination with taste and health affecting materials. The inspector has a low error return rate and a strong recognition rate and is resistant to parameter changes such as temperature fluctuation, air humidity and unclean air. The INNOCHECK FS operates with a velocity of 50,000 bottles per hour. The filling level checking system: the INNOCHECK FT 50 filling level checking system is available for checking the filling level of bottles and cans. Password-protected recording 20 different types of containers is part of the standard equipment as well as production statistics, counter readings for overfilling or underfilling, and diagnostic functions. The INNOCHECK FT 50 is easy to operate and features dependable filling level detection and a standardized link to reject systems. Crate checking: the INNOCHECK program offers various solutions for checking and detecting defective cartons, containers in cartons, shrink-wrap packaging, and plastic or metal closures. The simple and clearly arranged method of operation guarantees trouble-free machine performance for a multitude of applications.

Filling technology (INNOFILL) comprising: overpressure fillers—KHS offers several overpressure fillers: (INNOFILL EM, ER, EV, DR) equipped with mechanical and computer-controlled filling valves for filling carbonated beverages, particularly soft drinks and mineral water, in glass and plastic containers. A special feature of the INNOFILL EV is the volumetric recording of the filling volume using electromagnetic inductive flowmetering (MID). Capacities range from 5,000 to 80,000 bottles per hour, depending on the type of machine and the container to be filled. Normal pressure fillers: the KHS product program includes the INNOFILL NR double-chamber normal pressure bottle fillers. Equipped with computer-controlled filling valves, this filler is ideal for filling beverages in glass and plastic containers. The INNOFILL NR is capable of filling 6,000 to 70,000 0.7-liter bottles per hour. Can fillers: the INNOFILL product line for can filling is particularly suitable for filling beer, soft drinks, mixed beverages (carbonated and non-carbonated) as well as pulp and non-pulp juices (also hot filling). The complex filler program guarantees high performance standards and offers a host of engineering highlights, for instance, pressure-less filling of non-carbonated products. Or the extremely fast central filling level correction which can also be optionally used automatically during production operation. Particularly worthy of note are the filling temperatures; the approximate temperature for beer is 16 degrees Celsius, 20 degrees Celsius for soft drinks, and 85 degrees Celsius for juices. Rinsers: the KHS INNOFILL program includes two rinsers for single or double rinsing or blowing out of glass and plastic containers of various sizes and shapes. The EMZ/ZM rinser is a universal mechanical rinser with a capacity range from 10,000 to 75,000 bottles per hour. The universal computer-controlled triple-chamber DR rinser has the same capacity range. KHS offers the fully automatic DW can rinser designed for rinsing empty cans, which, depending on the configuration, is capable of outputs from 18,000 to 160,000 cans per hour. Pasteurizing technology (INNOPAS): KHS pasteurizers are ideal for heating glass, plastic, and metal containers. Beverages and foods such as beer, vegetable juices, fruit juices, fruit juice drinks, and other products are thus biologically preserved. These machines operate fully automatically using the continuous flow processes to gradually heat, pasteurize, and re-cool the product to be pasteurized during the treatment period. Depending on the equipment installed, the pasteurizers are capable of outputs ranging from 10,000 to 200,000 containers per hour. Heaters: the INNOPAS W, equipped with a continuously running conveyor belt, is a fully automatic machine for warming up cold-filled beverages or food products. The heater's conveyor belt can be made of plastic for can and plastic bottle processing or stainless steel for glass bottle processing. Capacities range from 5,000 to 120,000 container per hour. Re-coolers: the INNOPAS K, equipped with a continuously running conveyor belt, is a fully automatic machine for re-cooling hot-filled beverages or food products. Depending on their size, the re-coolers are designed as compact or segment-type machines. You may choose between plastic and stainless steel chain belts as a conveyor medium. Capacities range from 5,000 to 50,000 containers per hour.

Labeling technology (INNOKET): cold glue labeler—the INNOKET KL labeler is designed for cold glue processing of body, neck, back, neck ring, diagonal ribbon, and safety seal labels as well as aluminum foil. The product line is comprised of five different basic models which fulfill a host of customer capacity and equipment requirements through application-specific modular design (capacity range: 20,000 to 66,000 container per hour). The INNOKET KL can be optionally equipped with MIS, the Machine Information System. Hot-melt labelers: the INNOKET HL product line was developed especially for wrap-around labeling of glass and PET bottles, and cans. High-performance labelers for hot-melt processing. The gluing width is easily adapted to the various container material properties. Adhesives are gently treated by the "three-phase heat-up" (capacity range up to 45,000 per hour). Roll-fed labelers: the INNOKET RF is a high-performance labeler designed for processing paper or foil labels even as partial or wrap-around labels. The INNOKET RF offers dependable processing at capacities ranging up to 48,000 cans, glass or plastic bottles per hour, regardless if polypropylene, polyethylene, polystyrene or paper labels are used. Packing technology (INNOPACK): robots:KHS builds folding arm or one column robots for the application in the packing and palletizing area. Four axes folding arm robots are used, particularly where low performance and high flexibility are in demand by changing position pictures or applications. Three-axes column robots are ideal by their high-dynamic servo-drives, if short cycle times, high pay load and high throughput rates are required. Cyclic packer: Two models of the fully automatic INNOPACK cyclic packer product line are available: CT and GT. Both are ideal for packing or unpacking bottles, jars, cans, multi packs in plastic crates, carton, or trays. The cyclic packer's extremely efficient operation achieves high packing performance while requiring a minimum amount of space (INNOPACK CT: 500 to 1,900 packagings per hour, INNOPACK GT: 1,000 to 7,000 module crates per hour). Two INNOPACK CT models are available: the short stroke machine (packing movement) for plastic crate processing and the long stroke version (Packing movement) for folding box processing. Multipacker: the fully automatic operation of the INNOPACK GTM multipacker is used for combined packing of bulk containers in plastic crates and cartons or for placing multipacks in plastic crates, cartons, and trays. An outstanding feature of this machine is its horizontally moveable gripper traverse. Packing heads can be equipped as required with a gripping hook system, a vacuum gripping system, or a packing bell system, as well as a horizontally operating swivelling system. Rotary packer: the INNOPACK CR rotary packer is a continuously operating packing and unpacking machine designed for packing plastic crates or cartons (2,400 to 8,100 module crates per hour). It is capable of handling a multitude of tasks and its complex equipment makes it usable in all capacity ranges throughout the beverage industry. Two basic models of the rotary packer are available: size 1 for single and double-track crate conveyors, size 2 exclusively for double-track crate conveyors. Bottle aligner: KHS has developed a single and double-track, fully automatic INNOPACK FA series bottle alignment machine for integration in the packaging conveyor system for proper product presentation. The machine capacity is maximum 96,000 bottles per hour for a 6-second work cycle.

Palletizing technology (INNOPAL): palletizers: the INNOPAL palletizer concept is state-of-the-art and stands for high dependability, economy, and flexibility. Its modular design and versatility defined for customer advantage provide the ideal solution for each type of application. The INNOPAL PM and PL product lines offer machines and systems which can be equipped with a wide variety of loading heads. Nominal capacities range from 120 to 600 layers per hour depending on the model (single or double-column). Depalletizers: INNOPAL depalletizers are designed for the mid and upper capacity range. These machines depalletize by pushing jars, cans, glass or plastic bottles (also Petaloid-base bottles), even of various heights and diameters, layer by layer from pallets of the same size. Two models are available depending on the capacity and system configuration: the single-column, high-level packaging discharge INNOPAL AM with a capacity of 240 to 400 layers per hour and the double-column, low-level packaging discharge version of the INNOPAL AL with a capacity of up to 200 layers per hour. Crate stacker: the fully automatic plastic crate stackers of the INNOPAL KM product line are used as block buffer magazines if filling lines require buffer capacities exceeding 1,000 crates. They can be designed for a capacity of up to 10,000 crates. Pallet stackers: the fully automatic pallet stackers of the INNOPAL product line, stack or unstack pallets, kegs, crates, and with boxes to or from two or three-layers of pallets. Even various size pallets can be processed. Capacities range from 80 to 150 pallets per hour, depending on the model. Vertical pallet conveyors: the vertical pallet conveyors of the INNOPAL FM and FL product lines are fully automatic conveyor lines which link conveyor segments between floors or different levels. They are available in two models: INNOPAL FM. Single-column vertical conveyor ideal for conveying heights of up to 12 meters and loads of up to 1,000 kg. INNOPAL FL. Double-column, portal, vertical conveyor equipped with two lifting chains. The conveying height of the INNOPAL FL is up to 20 meters and the maximum load is 2,500 kg (two-space version).

Attendant equipment and systems such as plant information system (INNOLINE): the INNOLINE program includes conveyors designed for glass and PET bottles, and round, oval or rectangular shaped cans. In their capacity as linking elements between the processing stations, the container conveyors have a considerable effect on the function and efficiency of the overall system. For this reason, all models have the following distinguishing features; highly economical through the use of mechanical and electrical system of building blocks, optimum selection of materials, stable and sturdy design, easy to service through excellent accessibility, easy to clean, product-oriented conveyor regulation and controls, and low-pressure and low-noise conveying through SOFTSTEP MODULE. Pallet conveyors: KHS offers a conveyor system comprised of standard elements capable of performing all the horizontal and vertical level movements necessary for in-feeding and discharging pallets. The building block type design permits coupling of all units in order to simply and clearly perform the most varied of conveying tasks. The INNOLINE program includes horizontal pallet conveyors (equipped with roller or chain conveyors), and vertically conveying pallet magazines, as well as pallet checking systems. Crate magazines: the INNOLINE KMZ is an empty crate row magazine. Available are single or double-track versions. The storage capacity depends on the length and the number of rows. The single-track version has a capacity for 280 to 570 module crates and the double-track version 560 to 1140 module crates. The fully automatic operation of the crate row magazines solve the problem of adequate buffer space between craters and decraters. In order to be able to optimize plant productivity, one should know exactly where the weak points are. This is the purpose and the job of the INNOLINE Plant Information System (AIS). The AIS system, installed on a PC, handles the task of evaluating all production and disruption data collected, making it thus possible for plant operators to monitor the current status of the filling line at any time. All AIS information can also be integrated in other internal company DP systems. All of the above website information is hereby incorporated by reference as if set forth in its entirety herein.

Examples of bottling systems, which may be used in embodiments of the present invention, may be found in the following U.S. Patents, which are hereby incorporated by reference, as if set forth in their entirety herein include U.S. Pat. No. 5,558,138 issued to Stock, et al. on Sep. 24, 1996 and entitled "Process and apparatus for cleaning container handling machines such as beverage can filling machines"; U.S. Pat. No. 5,634,500 issued to Clüsserath et al. on Jun. 3, 1997 and entitled "Method for bottling a liquid in bottles or similar containers"; and U.S. Pat. No. 5,713,403 issued to Cl üsserath et al. on Feb. 3, 1998 and entitled "Method and system for filling containers with a liquid filling product, and filling machine and labeling device for use with this method or system". All of the above U.S. patent documents in this paragraph are assigned to KHS Maschinen- und Anlagenbau Aktiengesellschaft of Dortmund, Federal Republic of Germany.

Examples of container labeling and/or filling machines and components thereof and/or accessories therefor may be found in the following documents, which are hereby incorporated by reference, as if set forth in their entirety herein include U.S. Pat. No. 4,911,285 issued to Rogall, et al. on Mar. 27, 1990 and entitled "Drive for a rotary plate in a labeling machine for bottles"; U.S. Pat. No. 4,944,830 issued to Zodrow et al. on Jul. 31, 1990 and entitled "Machine for labeling bottles"; U.S. Pat. No. 4,950,350 issued to Zodrow et al on Aug. 21, 1990 and entitled "Machine for labeling bottles or the like"; U.S. Pat. No. 4,976,803 issued to Tomashauser et al. on Dec. 11, 1990 and entitled "Apparatus for pressing foil on containers, such as on the tops and the necks of bottles or the like"; U.S. Pat. No. 4,981,547 issued to Zodrow et al. on Jan. 1, 1991 and entitled "Mounting and drive coupling for the extracting element support of a labeling station for a labeling machine for containers and similar objects"; U.S. Pat. No. 5,004,518 issued to Zodrow on Apr. 2, 1991 and entitled "Labeling machine for objects such as bottles or the like"; U.S. Pat. No. 5,017,261 issued to Zodrow et al. on May 21, 1991 and entitled "Labeling machine for objects such as bottles or the like"; U.S. Pat. No. 5,062,917 issued to Zodrow et al. on Nov. 5, 1991 and entitled "Support element for the followers of a cam drive of a drive mechanism and a labeling station equipped with a support element"; U.S. Pat. No. 5,062,918 issued to Zodrow on Nov. 5, 1991 and entitled "Glue segments which can be attachable to a drive shaft of a labeling machine"; U.S. Pat. No. 5,075,123 issued to Schwinghammer on Dec. 24, 1991 and entitled "Process and apparatus for removing alcohol from beverages"; U.S. Pat. No. 5,078,826 issued to Rogall on Jan. 7, 1992 and entitled "Labeling machine for the labeling of containers"; U.S. Pat. No. 5,087,317 issued to Rogall on Feb. 11, 1992 and entitled "Labeling machines for the labeling of containers"; U.S. Pat. No. 5,110,402 issued Zodrow et al. on May 5, 1992 and entitled "Labeling machine for labeling containers such as bottles having a labeling box for a stack of labels in a labeling station"; U.S. Pat. No. 5,129,984 issued to Tomashauser et al on Jul. 14, 1992 and entitled "Machine for wrapping foil about the tops and necks of bottles"; U.S. Pat. No. 5,167,755 issued Zodrow et al. on Dec. 1, 1992 and entitled "Adhesive scraper which can be adjusted in relation to an adhesive roller in a labeling machine"; U.S. Pat. No. 5,174,851 issued Zodrow et al. on Dec. 29, 1992 and entitled "Labeling machine for labeling containers, such as bottles"; U.S. Pat. No. 5,185,053 issued to Tomashauser et al. on Feb. 9, 1993 and entitled "Brushing Station for a labeling machine for labeling bottles and the like"; U.S. Pat. No. 5,217,538 issued Buchholz et al. on Jun. 8, 1993 and entitled "Apparatus and related method for the removal of labels and foil tags adhering to containers, in particular, to bottles"; U.S. Pat. No. 5,227,005 issued to Zodrow et al. on Jul. 13, 1993 and entitled "Labeling station for labeling objects, such as bottles"; U.S. Pat. No. 5,413,153 issued to Zwilling et al. on May 9, 1995 and entitled "Container filling machine for filling open-top containers, and a filler valve therefor"; and U.S. Pat. No. 5,569,353 issued to Zodrow on Oct. 29, 1996 and entitled "Labeling machine and apparatus for the automatic loading of the main magazine of a labeling machine, and a supply magazine which can be used in such an apparatus". All of the above U.S. patent documents in this paragraph are assigned to KHS Maschinen- und Anlagenbau Aktiengesellschaft of Dortmund, Federal Republic of Germany. Some additional examples of container filling systems, valves or methods and their components which may be incorporated in an embodiment of the present invention may be found in U.S. Pat. No. 5,377,726 issued to Clüsserath on Jan. 3, 1995 and entitled "Arrangement for filling bottles or similar containers"; U.S. Pat. No. 5,402,833 issued to Clüsserath on Apr. 4, 1995 and entitled "Apparatus for filling bottles or similar containers"; U.S. Pat. No. 5,425,402 issued to Pringle on Jun. 20, 1995 and entitled "Bottling system with mass filling and capping arrays"; U.S. Pat. No. 5,445,194 issued to Clüsserath on Aug. 29, 1995 and entitled "Filling element for filling machines for dispensing a liquid filling material into containers"; and U.S. Pat. No. 5,450,882 issued to Gragun on Sep. 19, 1995 and entitled "Beverage dispensing apparatus and process", all of these U.S. patents being hereby expressly incorporated by reference as if set forth in their entirety herein.

Some further examples of container filling systems, valves or methods and their components which may possibly be incorporated into the present invention are to be found in U.S. Pat. No. 5,190,084 issued to Diehl et al. on Mar. 2, 1993 and entitled "Filling element for filling machines for dispensing liquid"; U.S. Pat. No. 5,195,331 issued to Zimmern et al. on Mach 23, 1993 and entitled "Method of using a thermal expansion valve device, evaporator and flow control means assembly and refrigerating machine"; U.S. Pat. No. 5,209,274 issued to LaWarre, Sr. on May 11, 1993 and entitled "Filling valve apparatus having shortened vent tube"; U.S. Pat. No. 5,217,680 issued to Koshiishi et al. an Jun. 8, 1993 and entitled "Liquid filling method for a high-temperature and high-pressure vessel and apparatus therefor"; and U.S. Pat. No. 5,241,996 issued to Werner et al. and entitled "Apparatus for filling liquid into containers", all of these U.S. patents being hereby expressly incorporated by reference as if set forth in their entirety herein.

Some yet further additional examples of container filling systems, apparatus or methods and their components which may possibly be incorporated into the present invention are to be found in U.S. Pat. No. 3,960,066 issued to LaRocco et al. on Jun. 1, 1976 and entitled "Beverage preparation apparatus"; U.S. Pat. No. 4,103,721 issued to Noguchi on Aug. 1, 1978 and entitled "Method and apparatus for bottling beer"; U.S. Pat. No. 4,124,043 issued to Noguchi on Nov. 7, 1978 and entitled "Method and apparatus for bottling"; U.S. Pat. No. 4,135,699 issued to Petzsch et al. on Jan. 23, 1979 and entitled "Control valve for gaseous and liquid media"; U.S. Pat. No. 4,146,065 issued to Borstelmann on Mar. 27, 1979 and entitled "Method and machine for charging liquid into containers"; U.S. Pat. No. 4,171,714 issued to Knabe et al. on Oct. 23, 1979 and entitled "Filling machine for charging containers with a liquid"; U.S. Pat. No.

4,549,272 issued to Hagan et al. on Oct. 22, 1985 and entitled "Apparatus for filling containers with prescribed quantity of product by weight"; U.S. Pat. No. 4,599,239 issued to Wieland et al. on Jul. 8, 1986 and entitled "Method of preparing nonalcoholic beverages starting with a deaerated low sugar concentration base"; U.S. Pat. No. 5,058,632 issued to Lawarre, Sr. et al. on Oct. 22, 1991 and entitled "Filling valve apparatus"; U.S. Pat. No. 5,318,078 issued to Hantmann on Jun. 7, 1994 and entitled "Process for bottling beverages"; U.S. Pat. No. 5,365,771 issued to Gysi et al. and entitled "Process and apparatus for testing bottles for contamination"; U.S. Pat. No. 5,409,545 issued to Levey et al. on Apr. 25, 1995 and entitled "Apparatus and method for cleaning containers"; U.S. Pat. No. 5,458,166 issued to Kronseder on Oct. 17, 1995 and entitled "Cleansing system for a container treating machine"; U.S. Pat. No. 5,566,695 issued to Levey et al. and entitled "Modular apparatus and method for cleaning containers"; U.S. Pat. No. 5,689,932 issued to Peronek et al. on Nov. 25, 1997 and entitled "Quick change method and apparatus for filling and capping machines"; U.S. Pat. No. 5,732,528 issued to Peronek et al. and entitled "Container guide for filling and capping machine"; U.S. Pat. No. 5,778,633 issued to Sweeny on Jul. 14, 1998 and entitled "Quick change ledge support assembly for filling and capping machines"; and U.S. Pat. No. 6,058,985 issued to Petri et al. on May 9, 2000 and entitled "Bottling machine with set-up table and a set-up table for a bottling machine and a set-up table for a bottle handling machine", all of these U.S. patents being hereby expressly incorporated by reference as if set forth in their entirety herein.

Some additional examples of methods and apparatuses for closing bottles and containers and their components which may possibly be incorporated in an embodiment of the present invention may be found in U.S. Pat. No. 5,398,485 issued to Osifchin on Mar. 21, 1995 and entitled "Bottle support mechanism for a capping machine"; U.S. Pat. No. 5,402,623 issued to Ahlers on Apr. 4, 1995 and entitled "Method and apparatus for closing bottles"; U.S. Pat. No. 5,419,094 issued to Vander Bush, Jr. et al. on May 30, 1995 and entitled "Constant speed spindles for rotary capping machine"; U.S. Pat. No. 5,425,402 issued to Pringle on Jun. 20, 1995 and entitled "Bottling system with mass filling and capping arrays"; U.S. Pat. No. 5,447,246 issued to Finke on Sep. 5, 1995 and entitled "Methods and combinations for sealing corked bottles"; U.S. Pat. No. 5,449,080 issued to Finke on Sep. 12, 1995 and entitled "Methods and combinations for sealing corked bottles"; and U.S. Pat. No. 5,473,855 issued to Hidding et al. and entitled "System for installing closures on containers", all of these U.S. patents being hereby expressly incorporated by reference as if set forth in their entirety herein.

Some further examples of methods and apparatuses for filling containers and their components which may possibly be incorporated in an embodiment of the present invention may be found in U.S. Pat. No. 3,946,770 issued to Trinne et al. on Mar. 30, 1976 and entitled "Bottle filling means and method"; U.S. Pat. No. 4136,719 issued to Kronseder et al. on Jan. 30, 1979 and entitled "Method and device for cleaning bottle filling machines and the like"; U.S. Pat. No. 4,446,673 issued to Desthieux on May 8, 1984 and entitled "Bottle-filling method and device"; U.S. Pat. No. 4,467,846 issued to Croser on Aug. 28, 1984 and entitled "Bottle filling device"; U.S. Pat. No. 4,653,249 issued to Simonazzi on Mar. 31, 1987 and entitled "Telescopic filling adapter for bottle filling machines"; U.S. Pat. No. 4,911,21 issued to Burton on Mar. 27, 1990 and entitled "Bottle filling device"; U.S. Pat. No. 4,967,813 issued to Ponvianne et al. on Nov. 6, 1990 and entitled "Bottle filling machine and filling head therefor"; U.S. Pat. No. 4,987,726 issued to Pethö et al. on Jan. 29, 1991 and entitled "Bottle filling and sealing apparatus"; U.S. Pat. No. 5,191,742 issued to Jones on Mar. 9, 1993 and entitled "Fluidized bed bottle filling system"; U.S. Pat. No. 5,454,421 issued to Kerger et al. on Oct. 3, 1995 and entitled "Device for filling and emptying a gas bottle"; U.S. Pat. No. 5,494,086 issued to McBrady et al. on Feb. 27, 1996 and entitled "Bottle filling machine"; U.S. Pat. No. 5,533,552 issued to Ahlers on Jul. 9, 1996 and entitled "Bottle filling machine and a cleansing system accessory including an operator therefor"; and U.S. Pat. No. 5,582,223 issued to Weh et al. on Dec. 10, 1996 and entitled "Filling apparatus for gas bottle valves", all of these U.S. patents being hereby expressly incorporated by reference as if set forth in their entirety herein.

Examples of rotary position sensors and rotary position indicators, components thereof, and components associated therewith, which may be utilized in accordance with the embodiments of the present invention, may be found in the following U.S. Patents: U.S. Pat. No. 4,360,889 issued to Liedtke on Nov. 23, 1982 and entitled "Rotary position indicating circuit"; U.S. Pat. No. 4,458,893 issued to Ruh on Jul. 10, 1984 and entitled "Drive for sheet feeder in printing press"; U.S. Pat. No. 4,581,993 issued to Schöneberger on Apr. 15, 1986 and entitled "Device for a printing press comprising a plate cylinder and/or blanket cylinder"; U.S. Pat. No. 4,841,246 issued to Juds et al. on Jun. 20, 1989 and entitled "Multiturn shaft position sensor having magnet movable with nonrotating linear moving unit"; U.S. Pat. No. 4,899,643 issued to Hvilsted et al. on Feb. 13, 1990 and entitled "Hydraulic cylinder comprising at least one electric position indicator"; U.S. Pat. No. 5,222,457 issued to Friedrich on Jun. 6, 1993 and entitled "Indicator for rotary positioner"; U.S. Pat. No. 5,396,139 issued to Surmely et al. on Mar. 7, 1995 and entitled "Polyphase electromagnetic transducer having a multipolar permanent magnet"; U.S. Pat. No. 5,419,195 to Quinn on May 30, 1995 and entitled "Ultrasonic booted head probe for motor bore inspection"; U.S. Pat. No. 5,424,632 issued to Montagu on Jun. 13, 1995 and entitled "Moving magnet optical scanner with novel rotor design"; U.S. Pat. No. 5,433,118 issued to Castillo on Jul. 18, 1995 and entitled "Magnetic turbine rotor for low flow fluid meter"; U.S. Pat. No. 5,442,329 issued to Ghosh et al. on Aug. 15, 1995 and entitled "Waveguide rotary joint and mode transducer structure therefor"and U.S. Pat. No. 5,444,368 issued to Horber on Aug. 22, 1995 and entitled "Differential reactance permanent magnet position transducer", all of these U.S. patents being hereby expressly incorporated by reference as if set forth in their entirety herein.

Examples of filling machines that utilize electronic control devices to control various portions of a filling or bottling process and which may possibly be utilized in connection with the present invention are to be found in U.S. Pat. No. 4,821,921 issued to Cartwright et al. on Apr. 18, 1989 and entitled "Liquid dispensing apparatus"; U.S. Pat. No. 5,056,511 issued to Ronge on Oct. 15, 1991 and entitled "Method and apparatus for compressing, atomizing, and spraying liquid substances"; U.S. Pat. No. 5,273,082 issued to Paasche et al. on May 27, 1992 and entitled "Method and apparatus for filling containers"; and U.S. Pat. No. 5,301,488 issued to Ruhl et al. on Nov. 6, 1992 and entitled "Programmable filling and capping machine", all of these U.S. patents being hereby expressly incorporated by reference as if set forth in their entirety herein.

Rotary mechanical devices relating to bottling are to be found in U.S. Pat. No. 4,976,803 issued to Tomashauser et al. on Dec. 11, 1990 and entitled "Apparatus for pressing foil on containers, such as on the tops and the necks of bottles or the like", also referred to above; U.S. Pat. No. 5,087,317 issued to Rogall on Feb. 11, 1992 and entitled "Labeling machine for the labeling of containers", also referred to above; U.S. Pat. No. 5,174,851 issued to Zodrow et al. on Dec. 29, 1992 and entitled Labeling machine for labeling containers, such as bottles", also referred to above; U.S. Pat. No. 5,185,053 issued to Tomashauser et al. on Feb. 9, 1993 and entitled "Brushing station for a labeling machine for labeling bottles and the like", also referred to above; U.S. Pat. No. 5,217,538 issued to Buchholz et al. on Jun. 8, 1993 and entitled "Apparatus and related method for the removal of labels and foil tags adhering to containers, in particular, to bottles", also referred to above; and U.S. Pat. No. 5,219,405 issued to Weiss on Jun. 15, 1993 and entitled "Continuously operating rotational bottle filling installation", and all of these U.S. patents being hereby expressly incorporated by reference as if set forth in their entirety herein.

Examples of capping devices which may possibly be incorporated into the present invention are to be found in U.S. Pat. No. 4,939,890 issued to Peronek et al. on Apr. 14, 1989 and entitled "Anti-rotation method and apparatus for bottle capping machines"; U.S. Pat. No. 5,150,558 issued to Bernhard on Jul. 5, 1991 and entitled "Closing mechanism for a capping machine"; U.S. Pat. No. 5,157,897 issued to McKee et al. on Oct. 27, 1992 and entitled "Rotary capping machine"; and U.S. Pat. No. 5,220,767 issued to de Santana on Jun. 22, 1993 and entitled "Device for applying a cap and seal to the mouth of a bottle whereon an interference boss is provided for said seal", all of these U.S. patents being hereby expressly incorporated by reference herein.

An example of an electric probe utilized in connection with a bottle filling process which may be incorporated into the present invention is to be found in U.S. Pat. No. 5,190,084 issued to Diehl et al. on May 3, 1991 and entitled "Filling element for filling machines for dispensing liquid", which U.S. patent is hereby expressly incorporated by reference as if set forth in its entirety herein.

Other examples of liquid level probes which may be incorporated into the present invention are to be found in U.S. Pat. No. 4,903,530 issued to Hull on Dec. 8, 1988 and entitled "Liquid level sensing system"; U.S. Pat. No. 4,908,783 issued to Maier on Apr. 28, 1987 and entitled "Apparatus and method for determining liquid levels"; and U.S. Pat. No. 4,921,129 issued on Jul. 11, 1988 to Jones et al. and entitled "Liquid dispensing module", all of these U.S. patents being hereby expressly incorporated by reference as if set forth in their entirety herein.

Some example computer systems and methods and their components which may possibly be incorporated in an embodiment of the present invention are to be found in U.S. Pat. No. 5,379,428 issued to Belo on Jan. 3, 1995 and entitled "Hardware process scheduler and processor interrupter for parallel processing computer systems"; U.S. Pat. No. 5,390,301 issued to Scherf on Feb. 14, 1995 and entitled "Method and apparatus for communicating device-specific information between a device driver and an operating system in a computer system"; U.S. Pat. No. 5,398,333 issued to Schieve et al. on Mar. 14, 1995 and entitled "Personal computer employing reset button to enter ROM-based diagnostics"; U.S. Pat. No. 5,404,544 issued to Crayford on Apr. 4, 1995 and entitled "System for periodically transmitting signal to/from sleeping node identifying its existence to a network and awakening the sleeping node responding to received instruction"; U.S. Pat. No. 5,418,942 issued to Krawchuk et al. on May 23, 1995 and entitled "System and method for storing and managing information"; U.S. Pat. No. 5,428,790 issued to Harper et al. on Jun. 27, 1995 and entitled "Computer power management system"; and U.S. Pat. No. 5,479,355 issued to Hyduke on Dec. 26, 1995 and entitled "System and method for a closed loop operation of schematic designs with electrical hardware", all of these U.S. patents being hereby expressly incorporated by reference as if set forth in their entirety herein.

Some examples of switches or levers, or components thereof, which may possibly be incorporated in an embodiment of the present invention are to be found in U.S. Pat. No. 5,392,895 issued to Sörensen on Feb. 28, 1995 and entitled "Transfer unit"; U.S. Pat. No. 5,404,992 issued to Robu et al. on Apr. 11, 1995 and entitled "Suspension conveyor system"; U.S. Pat. No. 5,438,911 issued to Fiedler et al. on Aug. 8, 1995 and entitled "Control cylinder for pneumatic control devices with signal switches"; U.S. Pat. No. 5,440,289 issued to Riordan on Aug. 8, 1995 and entitled "Combined alarm system and window covering assembly"; and U.S. Pat. No. 5,462,245 issued to Durchschlag and entitled "Apparatus for locking moveable switch parts", all of these U.S. patents being hereby expressly incorporated by reference as if set forth in their entirety herein.

Some examples of sensors and switches which may possibly be incorporated in an embodiment of the invention are to be found in U.S. Pat. No. 5,378,865 issued to Reneau on Jan. 3, 1995 and entitled "Multi-directional shock sensor"; U.S. Pat. No. 5,379,023 issued to Dalton on Jan. 3, 1995 and entitled "Alarm system"; U.S. Pat. No. 5,408,132 issued to Fericeau et al. on Apr. 18, 1995 and entitled "Proximity switch operating in a non-contacting manner"; U.S. Pat. No. 5,428,253 issued to Ogata et al. on Jun. 27, 1995 and entitled "Proximity switch"; U.S. Pat. No. 5,430,421 issued to Bornand et al. on Jul. 4, 1995 and entitled "Reed contactor and process of fabricating suspended tridimensional metallic microstructure"; U.S. Pat. No. 5,442,150 issued to Ipcinski on Aug. 15, 1995 and entitled "Piezo electric switch"; U.S. Pat. No. 5,444,295 issued to Lake et al. on Aug. 22, 1995 and entitled "Linear dual switch module"; U.S. Pat. No. 5,453,589 issued to Mayer on Sep. 26, 1995 and entitled "Microswitch with non-enlarging, sealed electrical connections"; and U.S. Pat. No. 5,453,590 issued to Mayer on Sep. 26, 1995 and entitled "Bistable microswitch", all of these U.S. patents being hereby expressly incorporated by reference as if set forth in their entirety herein.

Some examples of pressure sensors which may possibly be incorporated in an embodiment of the present invention are to be found in U.S. Pat. No. 4,703,657 issued to Hirama et al. on Nov. 3, 1987 and entitled "Gas pressure sensor"; U.S. Pat. No. 4,812,801 issued to Halvis et al. on Mar. 14, 1989 and entitled "Solid state gas pressure sensor"; U.S. Pat. No. 5,597,020 issued to Miller et al. on Jan. 28, 1997 and entitled "Method and apparatus for dispensing natural gas with pressure calibration"; U.S. Pat. No. 5,763,762 issued to Sweeney, Jr. on Jun. 9, 1998 and entitled "Total dissolved gas pressure sensor, replaceable collector module and process"; and U.S. Pat. .No. 5,925,823 issued to Buehler et al. on Jul. 20, 1999 and entitled "Alpha-particle gas-pressure sensor", all of these U.S. patents being hereby expressly incorporated by reference as if set forth in their entirety herein.

Some further examples of microcomputer control systems which may possibly be incorporated in an embodiment of the present invention are to be found in U.S. Pat. No.

5,530,515 issued to Saegusa et al. on Jun. 25, 1996 and entitled "Control system for an apparatus using a microprocessor"; U.S. Pat. No. 5,548,774 issued to Maurel on Aug. 20, 1996 and entitled "Microcomputer system providing time management enabling control and acquisition of data indicative of condition changes occurring at high speed"; U.S. Pat. No. 5,581,771 issued to Osakabe on Dec. 3, 1996 and entitled "Microcomputer having interrupt control circuit to determine priority level"; U.S. Pat. No. 5,610,749 issued to Mizoguchi et al. on Mar. 11, 1997 and entitled "Microcomputer control optical fiber transmission system"; U.S. Pat. No. 5,619,669 issued to Katsuta on Apr. 8, 1997 and entitled "Memory wait cycle control system for microcomputer"; U.S. Pat. No. 5,664,199 issued to Kuwahara on Sep. 2, 1997 and entitled "Microcomputer free from control of central processing unit (CPU) for receiving and writing instructions into memory independent of and during execution of CPU"; and U.S. Pat. No. 5,687,345 issued to Matsubara et al. on Nov. 11, 1997 and entitled "Microcomputer having CPU and built-in flash memory that is rewriteable under control of the CPU analyzing a command supplied from an external device", all of these U.S. patents being hereby expressly incorporated by reference as if set forth in their entirety herein.

Some further examples of microprocessor control systems which may possibly be incorporated in an embodiment of the present invention may be found in U.S. Pat. No. 4,202,035 issued to Lane on May 6, 1980 and entitled "Modulo addressing apparatus for use in a microprocessor"; U.S. Pat. No. 4,307,448 issued to Sattler on Dec. 22, 1981 and entitled "Method and a circuit arrangement for expanding the addressing capacity of a central unit, in particular of a microprocessor"; U.S. Pat. No. 4,419,727 issued to Holtey et al. on Dec. 6, 1983 and entitled "Hardware for extending microprocessor addressing capability"; U.S. Pat. No. 5,541,045 issued to Kromer, III on Sep. 10, 1985 and entitled "Microprocessor architecture employing efficient operand and instruction addressing"; U.S. Pat. No. 5,293,062 issued to Nakao on Mar. 8, 1994 and entitled FET nonvolatile memory with composite gate insulating layer"; U.S. Pat. No. 5,292,681 issued to Lee et al. on Mar. 8, 1994 and entitled "Method of processing a semiconductor wafer to form an array of nonvolatile memory devices employing floating gate transistors and peripheral area having CMOS transistors"; and U.S. Pat. No. 5,301,161 issued to Landgraf et al. on Apr. 5, 1994 and entitled "Circuitry for power supply voltage detection and system lockout for a nonvolatile memory", all of these U.S. patents being hereby expressly incorporated by reference as if set forth in their entirety herein.

Some examples of control valve apparatus and methods of operation thereof which possibly may be incorporated in an embodiment of the present invention may be found in U.S. Pat. No. 5,406,975 issued to Nakamichi et al. on Apr. 18, 1995 and entitled "Flow rate control valve"; U.S. Pat. No. 5,503,184 issued to Reinartz et al. on Apr. 2, 1996 and entitled "pressure control valve"; U.S. Pat. No. 5,706,849 issued to Uchida et al. on Jan. 13, 1998 and entitled "Flow control valve"; U.S. Pat. No. 5,975,115 issued to Schwegler et al. on Nov. 2, 1999 and entitled "Pressure control valve"; U.S. Pat. No. 6,142,445 issued to Kawaguchi et al. on Nov. 7, 2000 and entitled "Electromagnetic control valve"; U.S. Pat. No. 6,145,538 issued to Park on Nov. 14, 2000 and entitled "Flow control valve employing a step motor"; and U.S. Pat. No. 6,189,326 B1 issued to Tomatsu et al. on Feb. 20, 2001 and entitled "Pressure control valve", all of these U.S. patents being hereby expressly incorporated by reference as if set forth in their entirety herein.

Some examples of electric control valves which may possibly be used in an embodiment of the present invention may be found in U.S. Pat. No. 4,431,160 issued to Burt et al. on Feb. 14, 1984 and entitled "Electric control valve"; and U.S. Pat. No. 4,609,176 issued to Powers on Sep. 2, 1986 and entitled "Fluid flow control system with pulse driven electric control valve", all of these U.S. patents being hereby expressly incorporated by reference as if set forth in their entirety herein.

Some examples of pneumatic control valves which may possibly be incorporated in an embodiment of the present invention may be found in U.S. Pat. No. 4,302,057 issued to Durling on Nov. 24, 1981 and entitled "Pneumatic control valve"; U.S. Pat. No. 4,922,952 issued to Kemmler on May 8, 1990 and entitled "Pneumatic control valve"; U.S. Pat. No. 5,038,670 issued to Roe on Aug. 13, 1991 and entitled "Pneumatic control valve apparatus"; U.S. Pat. No. 5,218,994 issued to Jeschke on Jun. 15, 1993 and entitled "Arrangement having a pneumatic control valve with a housing closed on all sides"; and U.S. Pat. No. 5,918,631 issued to Weiler, Jr. et al. on Jul. 6, 1999 and entitled "Ball-poppet pneumatic control valve", all of these U.S. patents being hereby expressly incorporated by reference as if set forth in their entirety herein.

Some examples of methods and apparatus for gas recovery in beverage filling or bottling features of which may possibly be incorporated in an embodiment of the present invention may be found in U.S. Pat. No. 4,390,048 issued to Zelder on Jun. 28, 1983 and entitled "Method and device for recovering an inert gas"; U.S. Pat. No. 4,637,438 issued to Weiss on Jan. 20, 1987 and entitled "Method and device for filling containers"; U.S. Pat. No. 4,693,054 issued to Spargo on Sep. 15, 1987 and entitled "Process for filling beer into containers"; U.S. Pat. No. 4,949,764 issued to Clüsserath on Aug. 21, 1990 and entitled "Method for filling containers with carbonated liquid under counterpressure as dispensed having different filling characteristics by adjusting pressure differential without changing flow control mechanism"; U.S. Pat. No. 4,976,295 issued to Clüsserath on Dec. 11, 1990 and entitled "Apparatus for filling containers with carbonated liquid under counterpressure as dispensed having different filling characteristics by adjusting pressure differential without changing flow control mechanism"; U.S. Pat. No. 5,016,684 issued to Clüsserath on May 21, 1991 and entitled "Method and apparatus for dispensing carbonated liquids, especially beverages, into containers using counter pressure; and U.S. Pat. No. 5,329,963 issued to Jones et al. on Jul. 19, 1994 and entitled "Method of and apparatus for packaging a beverage in a container", all of these U.S. patents being hereby expressly incorporated by reference as if set forth in their entirety herein.

Some additional examples of counter-pressure filling methods and apparatus features of which may possibly be used in an embodiment of the present invention may be found in U.S. Pat. No. 4,089,353 issued to Antonelli on May 16, 1978 and entitled "Filling valve for carbonated liquid bottling machines"; U.S. Pat. No. 5,273,084 issued to Monnig on Dec. 28, 1993 and entitled "Gas flow check valve for bottle filling device"; U.S. Pat. No. 5,884,677 issued to McKaughan on Mar. 23, 1999 and entitled "Beverage filling machine"; U.S. Pat. No. 5,924,462 issued to McKaughan on Jul. 20, 1999 and entitled "Beverage filling machine"; U.S. Pat. No. 6,076,567 issued to Naecker et al. on Jun. 20, 2000 and entitled "Filling machine assembly"; and U.S. Pat. No. 6,109,483 issued to Wilke et al. on Aug. 29, 2000 and entitled "Filling machine assembly having a movable vent tube", all of these U.S. patents being hereby expressly incorporated by reference as if set forth in their entirety herein.

The details in the patents, patent applications and publications may be considered to be incorporable, at Applicant's option, into the claims during prosecution as further limitations in the claims to patentably distinguish any amended claims from any applied prior art.

Some further examples of bottling systems and features, which may possibly be used in embodiments of the present invention, which are incorporated by reference, as if set forth in their entirety herein, are to be found in U.S. patent application Ser. No. 08/238,613 filed on May 5, 1994 entitled "Apparatus for sorting bottles or similar containers", having inventors Christoph WEISSENFELS and Manfred LONNIG, which corresponds to Federal Republic of Germany patent application No. P 43 15 038, filed May 6, 1993, which corresponds to DE-OS 43 15 038 and DE-PS 43 15 038; U.S patent application Ser. No. 08/246,605 filed on May 20, 1994 entitled "Method and arrangement for converting a single-row stream of containers into a multi-row stream of containers", having inventor Heinz-Jürgen SCHERER, which corresponds to Federal Republic of Germany patent application No. P 43 17 069 filed on May 21, 1993, which corresponds to DE-OS 43 17 069 and DE-PS 43 17 069; U.S. patent application Ser. No. 08/372674 filed on Jan. 16, 1995 entitled "Apparatus for processing containers returned to food and beverage producers for the refilling of the containers", having inventor Karl HEIDRICH, which corresponds to Federal Republic of Germany patent application No. P 42 23 427 filed on Jul. 16, 1992, which corresponds to DE-OS 42 23 427 and DE-PS 42 23 427, and International application No. PCT/DE93/00586 filed on Jul. 1, 1993, which corresponds to WO 94/02848; U.S. patent application Ser. No. 08/383,156 filed on Feb. 3, 1995 entitled "Apparatus for processing containers returned to food and beverage producers for the refilling of the containers", having inventors Rudiger STRAUCHMANN, Marten PETERS, and Hubert GAISBAUER, which corresponds to Federal Republic of Germany patent application No. P 42 25 984 filed on Aug. 6, 1992, which corresponds to DE-OS 42 25 984 and DE-PS 42 25 984, and International application No. PCT/DE93/00692 filed Aug. 4, 1993, which corresponds to WO 94/03287; all of the above U.S. patent documents in this paragraph are assigned to KHS Maschinen- und Anlagenbau Aktiengesellschaft of Dortmund, Federal Republic of Germany.

U.S patent application Ser. No. 09/282,975 38,613 filed on Mar. 31,1999, having the inventor Herbert BERNHARD, with and claiming priority from Federal Republic of Germany Patent Application No. 198 14 625.6 which was filed on Apr. 1, 1998, and DE-OS 198 14 625.6 and DE-PS 198 14 625.6, are hereby incorporated by reference as if set forth in their entirety herein.

U.S. Pat. No. 6,213,169 B1 issued on Apr. 10, 2001, to Ludwig CLÜSSERATH, and entitled, "Single-chamber filling system" and claiming priority from Federal Republic of Germany Patent Application No. 198 18 761.0 which was filed on Apr. 27, 1998, and DE-OS 198 18 761.0 and DE-PS 198 18 761.0, are hereby incorporated by reference as if set forth in their entirety herein.

U.S. Pat. No. 6,189,578 B1 issued on Feb. 20, 2001, to Ludwig CLÜSSERATH and entitled, "Filling system and filling element" and claiming priority from Federal Republic of Germany Patent Application No. 198 18 762.9 which was filed on Apr. 27, 1998, and DE-OS 198 18 762.9 and DE-PS 198 18 762.9, are hereby incorporated by reference as if set forth in their entirety herein U.S. Pat. No. 6,192,946 B1 issued on Feb. 27, 2001, to Ludwig CLÜSSERATH and entitled, "Bottling system" and claiming priority from Federal Republic of Germany Patent Application No. 198 36 500 which was filed on Apr. Aug. 12, 1998, and DE-OS 198 36 500 and DE-PS 198 36 500, are hereby incorporated by reference as if set forth in their entirety herein.

U.S. patent application Ser. No. 09/551,126, filed on Apr. 18, 2000, having and entitled, "Method and apparatus for cleaning filter candles of a candle filter," having inventors Roland KRÜGER, Markus KOLCZYK, Rainer KUHNT, and Dietmar OECHSLE, and claiming priority from Federal Republic of Germany Patent Application No. 198 37 569.7, filed on Aug. 19, 1998, and from International Patent Application No. PCT/EP99/05768, filed on Aug. 9, 1999, and DE-OS 198 37 569 and DE-PS 198 37 569, are hereby incorporated as if set forth in their entirety herein.

U.S. patent application Ser. No. 09/574,516, filed on May 19, 2000, having and entitled, "Method of cleaning filter housings," having inventors Roland KRÜGER, Markus KOLCZYK, Rainer KUHNT, and Dietmar OECHSLE, and claiming priority from Federal Republic of Germany Patent Application No. 198 43 308.5, filed on Aug. 19, 1998, and from International Patent Application No. PCT/EP99/05779, filed on Aug. 9, 1999, and DE-OS 198 43 308 and DE-PS 198 43 308, are hereby incorporated as if set forth in their entirety herein.

U.S. patent application Ser. No. 09/590,351, filed on Jun. 8, 2000, having and entitled, "Method for filling and capping containers such as screw top bottles and the screw top closures therefore," having inventors Roland KRÜGER, Markus KOLCZYK, Rainer KUHNT, and Dietmar OECHSLE, and claiming priority from Federal Republic of Germany Patent Application No. 199 60 860, filed on Dec. 1, 1999, and from Federal republic of Germany Patent Application No. 199 26 293, filed on Jun. 9, 1999 and DE-DOS 199 60 860 and DE-PS 199 60 860, as well as DE-OS 199 26 293 and DE-PS 199 26 293, are hereby incorporated as if set forth in their entirety herein.

U.S. patent application Ser. No. 09/792,129, filed on Feb. 22, 2001, having inventors Ludwig CLÜSSERATH and Manfred HÄRTEL and entitled, "Beverage filling machine, system as well as method for filling containers with a liquid filling material, and claiming priority from Federal Republic of Germany Patent Application No. 100 08 426, filed on Feb. 23, 2000, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

U.S. patent application Ser. No. 09/803,728, filed on Mar. 9, 2001, having inventors Siegmar SINDERMANN and entitled, "Apparatus for displacing foam and air in a container filled with a beverage and apparatus for displacing the remaining air volume in a container filled with filling material," and claiming priority from Federal Republic of Germany Patent Application No. 100 11 653, filed on Mar. 10, 2000, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

U.S. patent application Ser. No. 09/808,411, filed on Mar. 14, 2001, having inventor Siegmar SINDERMANN and entitled, "Apparatus for the recovery of an inert gas in counter-pressure beverage filling machines and a beverage filling apparatus for stabilizing an inert gas such as carbon dioxide in the containers filled by the beverage filling machine," and claiming priority from Federal Republic of Germany Patent Application No. 100 12 684, filed on Mar. 10, 2000, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

Some examples of methods and apparatus of carbonation beverages features of which may possibly be used in at least one embodiment of the present invention may possibly be found in the following U.S. patents: U.S Pat. No. 3,992,493 issued to Whyte et al. on Nov. 16, 1976 and entitled, "Beverage carbonation," U.S. Pat No. 4,466,342 issued to Basile et al. on Aug. 21, 1984 and entitled, "Carbonation chamber with sparger for beverage carbonation," U.S. Pat. No. 4,517,135 issued to Szerenyi et al. on May 14, 1985 and entitled, "Carbonation measuring system and process," U.S. Pat. No. 4,607,342 issued to Seiden et al. on Aug. 19, 1986 and entitled Apparatus for remotely measuring and controlling the carbon dioxide in a beverage liquid: on-line," U.S. Pat. No. 4,636,337 issued to Gupta et al. on Jan. 13, 1987 and entitled, "Apparatus for rapid carbonation," U.S. Pat. No. 4,656,933 issued to Aschberger et al. on Apr. 14, 1987 and entitled, "Water-carbonizing system," U.S. Pat. No. 4,804,112 issued to Jeans on Feb. 14, 1989 and entitled, "Carbonating apparatus," U.S. Pat. No. 5,473,161 issued to Nix et al. on Dec. 5, 1995 and entitled, "Method for testing carbonation loss from beverage bottles using IR spectroscopy," and No. 5,656,313 issued to Gibney et al. on Aug. 12, 1997 and entitled, "Method of beverage blending and carbonation." All of the foregoing patents are hereby incorporated by reference as if set forth in their entirety herein.

Examples of can closing method and apparatus, features of which may possibly be used or adapted for use with an embodiment of the present invention may be found in the following U.S. patents: U.S Pat. No. 4,257,341 issued to Roberts on Mar. 24, 1981 and entitled, "Spring pressure adjusting tool for can closing machine," U.S. Pat. No. 4,582,216 issued to Byrd on Apr. 15, 1986 and entitled, "Easy open-reclosable container with pouring lip/drain surface," U.S. Pat. No. 4,705,186 issued to Barrach on Nov. 10, 1987 and entitled, "Can end assembly," U.S. Pat. No. 4,979,635 issued to Levine on Dec. 25, 1990 and entitled, "Easy opening can with internal reclosure flap," and U.S Pat. No. 5,996,832 issued to Nieuwoudt on Dec. 7, 1999 and entitled, "Cover for beverage can." All of the foregoing patents are hereby incorporated by reference as if set forth in their entirety herein.

Examples of containerization and packaging of beverage containers, features of which may possibly be used or adapted for use with an embodiment of the present invention may be found in the following U.S. patents: U.S Pat. No. 3,942,631 issued to Sutherland et al. on Mar. 9, 1976 and entitled, "Multi-unit packaging method and package," U.S. Pat. No. 4,029,204 issued to Manizza on Jun. 14, 1977 and entitled, "Bottle package," U.S. Pat. No. 4,703,855 issued to Moe et al. on Nov. 3, 1987 and entitled, "System for storing and shipping containers," U.S. Pat. No. 5,921,740 issued to Stewart on Jul. 13,1999 and entitled, "Device for an automatically loading a container," and U.S Pat. No. 6,189,330 issued to Retachick et al. on Feb. 20, 2001 and entitled, "Container, system and process for shipping." All of the foregoing patents are hereby incorporated by reference as if set forth in their entirety herein.

Examples of counter-pressure beverage filling machines may be found in the following U.S. patents, mentioned above: U.S. Pat. Nos. 5,413,153, 6,189,578, and 6,192,946.

This invention as described herein above in the context of the preferred embodiments is not to be taken as limited to all of the provided details thereof, since modifications and variations thereof may be made without departing from the spirit and scope of the invention.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

AT LEAST PARTIAL INDEX OF REFERENCE NUMERALS

| | |
|---|---|
| 1 | Filling machine |
| 2 | Bottle |
| 2' | Bottle mouth |
| 3 | Rotor |
| 4 | Filling device |
| 5 | Container carrier |
| 6 | Lifting curve |
| 7 | Lifting piston-cylinder |
| 8 | Conveyor |
| 9 | Bottle input |
| 10 | Bottle output |
| 11 | Housing |
| 12 | Fluid channel |
| 12' | Conduit |
| 12" | Annular opening |
| 13 | Fluid valve |
| 14 | Annular boiler |
| 14' | Filling material compartment |
| 14" | Gas compartment |
| 15 | Conduit |
| 16 | Conduit |
| 17 | Annular channel |
| 18 | Conduit |
| 19 | Annular channel |
| 20 | Annular channel |
| 21 | Conduit |
| 22 | Return gas tube |
| 23 | Gas path |
| 23' | Gas channel |
| 24 | Control valve apparatus |
| 24' | Control valve |
| 25 | Carbonation tube |
| 26 | Conduit |
| 27 | Control valve |
| 28 | Volume measuring element or quantity measuring element |
| 29 | Check valve |
| 30 | Gas channel in return gas tube |
| 31 | Seal |
| 33 | Volume measuring apparatus |
| 34 | Conduit |
| 35 | Annular channel |
| A | Direction of rotation of rotor |

What is claimed is:

1. A method of operating a machine for filling beverage containers, said containers comprising beverage bottles or beverage cans, with liquid beverage filling material using the beverage filling machine having a plurality of beverage filling positions, each filling position comprising a beverage filling device for filling a beverage container, each filling device comprising a return tube and a carbonation tube, said method comprising the steps of:

moving a beverage container to be filled in sequence with other containers to said filling machine;

elevating said beverage container to be filled to a corresponding filling device thereby introducing a corresponding return tube and a corresponding carbonation tube of said beverage filling device through the mouth of said beverage container into the interior of said beverage container, and positioning said carbonation tube deeper into said beverage container than said return tube;

sealing said beverage container to be filled against the corresponding filling device;

purging said sealed beverage container by introducing a carbonating material into the interior of said sealed beverage container by way of said carbonation tube, to thereby displace residual air present out of said sealed beverage container; terminating said step of purging;

at the end of said purging step, introducing a flow of a predetermined volume of non-carbonated liquid beverage filling material into the interior of said sealed beverage container with a filling device without adding additional carbonating material;

terminating the step of flowing non-carbonated liquid beverage filling material into the interior of said sealed beverage container;

introducing a predetermined quantity of carbonating material through said carbonation tube into the liquid beverage filling material present in said sealed beverage container, in a sufficient quantity with a sufficient pressure to effect carbonation with a sufficient saturation of said liquid beverage filling material in said sealed beverage container to absorb the carbonating material in said liquid beverage filling material, at a pressure level above the saturation pressure sufficient to produce a carbonated beverage;

terminating the step of introducing carbonating material; calming the carbonated beverage filling material in said sealed beverage container for a predetermined period of time to attain a pressure markedly below the carbonating material saturation pressure and thus removing excess bubbles;

reducing the pressure in said sealed beverage container to a final pressure;

distancing said filled beverage container filled with carbonated liquid beverage from the sealing relationship with the corresponding filling device; and removing said filled beverage container from said filling machine.

2. The method according to claim 1, wherein:

said step of introducing a predetermined quantity of carbon dioxide gas into the liquid beverage filling material is carried out after said step of terminating the step of flowing non-carbonated liquid beverage filling material into the interior of said sealed beverage container;

said non-carbonated liquid beverage filling material is one of (i.) and (ii.):

(i.) a liquid beverage filling material without carbon dioxide content; and (ii.) a liquid beverage filling material with a carbon dioxide content that is substantially below the level of the carbon dioxide content of a carbonated beverage;

prior to said step of introducing a predetermined quantity of carbon dioxide gas through said carbonation tube into the liquid beverage filling material, to carbonate the liquid beverage filling material, prepressurizing the beverage container is carried out to one of (i.) and (ii.):

(i.) a predetermined prepressurization pressure; and (ii.) the saturation pressure of carbon dioxide of said liquid beverage filling material; and further comprising:

carrying out at least one of (i.) and (ii.):

(i.) prepressurizing the beverage container prior to said step of introducing a flow of a predetermined volume of non-carbonated liquid beverage filling material into the interior of said sealed beverage container; and (ii.) prepressurizing after said step of filling each of said sealed beverage containers with said predetermined volume of non-carbonated liquid beverage filling material;

said step of introducing a predetermined quantity of carbon dioxide gas through said carbonation tube into the liquid beverage filling material present in said sealed beverage containers, to carbonate said liquid beverage filling material, is carried out at a pressure which is markedly above (i.) and (ii.):

(i.) the prepressurization pressure; and (ii.) the saturation pressure of carbon dioxide of said liquid beverage filling material; and wherein:

prior to said step of introducing a flow of a predetermined volume of non-carbonated liquid beverage filling material into the interior of said sealed beverage container there is carried out said step of purging each of said beverage containers;

said step of filling said sealed beverage container is carried out under gravity flow of said non-carbonated liquid beverage filling material at atmospheric pressure;

said step of filling said sealed beverage container with non-carbonated liquid beverage filling material comprises pressurizing said liquid beverage filling material to a pressure higher than a prevailing pressure in said beverage containers after said step of introducing a predetermined quantity of carbon dioxide gas through said carbonation tube into the liquid beverage filling material, to carbonate said liquid beverage filling material, reducing a prevailing pressure in said beverage containers to atmospheric pressure; and wherein:

reducing a prevailing pressure to atmospheric pressure is carried out by one of (i.) and (ii.):

(i.) in one step to atmospheric pressure; and (ii.) in two steps; said two steps comprising (1.) and (11.):

(1.) reducing a prevailing pressure to a predepressurizing pressure above atmospheric pressure; and (11.) reducing the pressure from said predepressurizing pressure to atmospheric pressure; and said beverage container comprise one of (i.) and (ii.):

(i.) a beverage bottle, and (ii.) a beverage can.

3. The method according to claim 2, comprising:

reducing the pressure of said non-carbonated liquid beverage filling material in said container to a predetermined depressurization pressure; and wherein:

said step of calming the carbonated beverage filling material is carried out between said step of reducing the pressure of said non-carbonated liquid beverage filling material in said container to a predetermined depressurization pressure and said step of reducing the gas pressure to a final pressure; and after said step of introducing a predetermined quantity of carbon dioxide gas through said carbonation tube into the liquid beverage filling material and during said step of reducing the pressure of said non-carbonated liquid beverage filling material in said container to a predetermined depressurization pressure, carrying out a depressurizing also of the interior space of said carbonation tube.

4. A method of operating a plant to produce a carbonated beverage by filling beverage containers with liquid beverage filling material and carbonating said liquid beverage filling material in said beverage containers with carbon dioxide gas using a beverage filling machine and a container closing arrangement, said beverage filling machine having a plurality of beverage filling positions, each beverage filling position comprising a beverage filling device for filling beverage containers, said method comprising the steps of:

moving beverage containers to be filled to said filling machine;

sealing the beverage containers to be filled against corresponding beverage filling devices;

introducing a flow of liquid beverage filling material into the interior of each of said sealed beverage containers;

filling each of said sealed beverage containers to a substantially predetermined level with said liquid beverage filling material;

terminating the step of filling said sealed beverage containers upon reaching said substantially predetermined level of liquid beverage filling material in each of said sealed beverage containers;

introducing carbon dioxide gas into the liquid beverage filling material present in said sealed beverage containers at a pressure sufficient to produce a carbonated beverage from said liquid beverage filling material present in each of said sealed beverage containers by mixing said liquid beverage filling material and said carbon dioxide gas in said sealed beverage containers and producing a carbonated beverage in said sealed containers;

terminating the step of introducing carbon dioxide gas;

distancing beverage containers filled with said carbonated beverage from the corresponding beverage filling devices;

said method further comprising the steps of:

moving said beverage containers filled with said carbonated beverage from said beverage filling machine to said container sealing arrangement;

moving said beverage containers filled with said carbonated beverage into said container sealing arrangement; and closing each of said beverage containers filled with said carbonated beverage in each of said beverage containers with a closing device and thus preventing the carbon dioxide in said beverage containers filled with said carbonated beverage from substantially leaking from said beverage containers filled with said carbonated beverage at least prior to shipping;

said method yet further comprising the step of:

preparing the closed sealed beverage containers filled with said carbonated beverage for shipping from said plant to consumers.

5. The method according to claim 4, wherein:

said step of introducing a flow of liquid beverage filling material into the interior of each of said sealed beverage containers comprises introducing a flow of non-carbonated liquid beverage filling material into the interior of each of said sealed beverage containers; and wherein said step of introducing carbon dioxide gas comprises:

introducing carbon dioxide gas into the non-carbonated liquid beverage filling material present in said sealed beverage containers at a pressure sufficient to effectuate carbonation of said non-carbonated liquid beverage filling material, and carbonating said non-carbonated liquid beverage filling material in said sealed containers and thus effectuating absorption of carbon dioxide gas into said non-carbonated liquid beverage filling material to produce a carbonated beverage from said non-carbonated liquid beverage filling material.

6. The method according to claim 4, wherein:

said step of introducing carbon dioxide gas into the non-carbonated liquid beverage filling material is carried out after said step of terminating the step of filling said sealed beverage containers;

said liquid beverage filling material is one of (i.) and (ii.):

(i.) a liquid beverage filling material without carbon dioxide content; and (ii.) a liquid beverage filling material with a carbon dioxide content that is substantially below the level of the carbon dioxide content of a carbonated beverage;

said step of introducing carbon dioxide gas into the non-carbonated liquid beverage filling material comprises submerging apparatus having at least one gas opening in the non-carbonated liquid beverage filling material; and continuing introducing said carbon dioxide gas until a predetermined pressure has been attained;

prior to said step of introducing carbon dioxide gas into the non-carbonated liquid beverage filling material to carbonate the non-carbonated liquid beverage filling material, prepressurizing the beverage containers to one of (i.) and (ii.):

(i.) a predetermined prepressurization pressure; and (ii.) the saturation pressure of carbon dioxide of said non-carbonated liquid beverage filling material; and carrying out at least one of (i.) and (ii.):

(i.) prepressurizing of the beverage containers prior to said step of introducing a flow of liquid beverage filling material into the interior of each of said sealed beverage containers; and (ii.) prepressurizing after said step of filling each of said sealed beverage containers with said non-carbonated liquid beverage filling material.

7. The method according to claim 6, wherein:

said step of introducing carbon dioxide gas into the non-carbonated liquid beverage filling material present in said sealed beverage containers, to carbonate said non-carbonated liquid beverage filling material, is carried out at a pressure which is markedly above (i.) and (ii.):

(i.) the prepressurization pressure; and (ii.) the saturation pressure of carbon dioxide of said non-carbonated liquid beverage filling material;

prior to said step of introducing a flow of non-carbonated liquid beverage filling material into the interior of each of said sealed beverage containers there is carried out the step of purging each of said beverage containers; and said step of purging is carried out with a carbon dioxide containing gas.

8. The method according to claim 7, wherein:

said step of filling each of said sealed beverage containers is carried out under gravity flow of said non-carbonated liquid beverage filling material at atmospheric pressure.

9. The method according to claim 8, wherein:

said step of filling each of said sealed beverage containers with non-carbonated liquid beverage filling material comprises pressurizing said non-carbonated liquid beverage filling material to a pressure higher than a prevailing pressure in said beverage containers.

10. The method according to claim 9 comprising:

after said step of introducing carbon dioxide gas into the non-carbonated liquid beverage filling material, to carbonate said non-carbonated liquid beverage filling material, reducing a prevailing pressure in said beverage containers to atmospheric pressure; and wherein:

reducing a prevailing pressure to atmospheric pressure is carried out by one of (i.) and (ii.):

(i.) in one step to atmospheric pressure; and (ii.) in two steps; said two steps comprising (I.) and (II.):

(I.) reducing a prevailing pressure to a predepressurizing pressure above atmospheric pressure; and (II.) reducing the pressure from said predepressurizing pressure to atmospheric pressure.

11. The method according to claim 10, wherein:

said beverage containers comprise one of (i.) and (ii.):

(i.) bottles, and (ii.) cans.

12. The method according to claim 11 comprising at least one of:

said step of introducing carbon dioxide gas into the non-carbonated liquid beverage filling material is carried out after said step of terminating the step of filling said sealed beverage containers;

said liquid beverage filling material is one of (i.) and (ii.):

(i.) a liquid beverage filling material without carbon dioxide content; and (ii.) a liquid beverage filling material with a carbon dioxide content that is substantially below the level of the carbon dioxide content of a carbonated beverage;

said step of introducing carbon dioxide gas into the non-carbonated liquid beverage filling material comprises submerging apparatus having at least one gas opening in the non-carbonated liquid beverage filling material; and continuing introducing said carbon dioxide gas until a predetermined pressure has been attained;

prior to said step of introducing carbon dioxide gas into the non-carbonated liquid beverage filling material to carbonate the liquid beverage filling material, prepressurizing the beverage containers to one of (i.) and (ii.):

(i.) a predetermined prepressurization pressure; and (ii.) the saturation pressure of carbon dioxide of said non-carbonated liquid beverage filling material; and carrying out at least one of (i.) and (ii.):

(i.) prepressurizing of the beverage containers prior to said step of introducing a flow of non-carbonated liquid beverage filling material into the interior of each of said sealed beverage containers; and (ii.) prepressurizing after said step of filling each of said sealed beverage containers with said non-carbonated liquid beverage filling material;

said step of introducing carbon dioxide gas into the non-carbonated liquid beverage filling material present in said sealed beverage containers, to carbonate said non-carbonated liquid beverage filling material, is carried out at a pressure which is markedly above (i.) and (ii.):

(i.) the prepressurization pressure; and (ii.) the saturation pressure of carbon dioxide of said non-carbonated liquid beverage filling material;

prior to said step of introducing a flow of non-carbonated liquid beverage filling material into the interior of each of said sealed beverage containers there is carried out the step of purging each of said beverage containers;

said step of purging is carried out with a carbon dioxide containing gas;

said step of filling each of said sealed beverage containers is carried out under gravity flow of said non-carbonated liquid beverage filling material at atmospheric pressure;

said step of filling each of said sealed beverage containers with non-carbonated liquid beverage filling material comprises pressurizing said non-carbonated liquid beverage filling material to a pressure higher than a prevailing pressure in said beverage containers;

after said step of introducing carbon dioxide gas into the non-carbonated liquid beverage filling material, to carbonate said liquid beverage filling material, reducing a prevailing pressure in said beverage containers to atmospheric pressure; and wherein:

reducing a prevailing pressure to atmospheric pressure is carried out by one of (i.) and (ii.):

(i.) in one step to atmospheric pressure; and (ii.) in two steps; said two steps comprising (I.) and (II.):

(I.) reducing a prevailing pressure to a predepressurizing pressure above atmospheric pressure; and (II.) reducing the pressure from said predepressurizing pressure to atmospheric pressure; and said beverage containers comprise one of (i.) and (ii.):

(i.) bottles, and (ii.) cans.

13. The method according to claim 4 comprising all of:

said step of introducing carbon dioxide gas into the liquid beverage filling material is carried out after said step of terminating the step of filling said sealed beverage containers; said liquid beverage filling material is one of (i.) and (ii.):

(i.) a liquid beverage filling material without carbon dioxide content; and (ii.) a liquid beverage filling material with a carbon dioxide content that is substantially below the level of the carbon dioxide content of a carbonated beverage;

said step of introducing carbon dioxide gas into the non-carbonated liquid beverage filling material comprises submerging apparatus having at least one gas opening in the liquid beverage filling material; and continuing introducing said carbon dioxide gas until a predetermined pressure has been attained;

prior to said step of introducing carbon dioxide gas into the non-carbonated liquid beverage filling material to carbonate the non-carbonated liquid beverage filling material, prepressurizing the beverage containers to one of (i.) and (ii.):

(i.) a predetermined prepressurization pressure; and (ii.) the saturation pressure of carbon dioxide of said non-carbonated liquid beverage filling material; and carrying out at least one of (i.) and (ii.):

(i.) prepressurizing of the beverage containers prior to said step of introducing a flow of non-carbonated liquid beverage filling material into the interior of each of said sealed beverage containers; and (ii.) prepressurizing after said step of filling each of said sealed beverage containers with said non-carbonated liquid beverage filling material;

said step of introducing carbon dioxide gas into the non-carbonated liquid beverage filling material present in said sealed beverage containers, to carbonate said non-carbonated liquid beverage filling material, is carried out at a pressure which is markedly above (i.) and (ii.):

(i.) the prepressurization pressure; and (ii.) the saturation pressure of carbon dioxide of said non-carbonated liquid beverage filling material;

prior to said step of introducing a flow of non-carbonated liquid beverage filling material into the interior of each of said sealed beverage containers there is carried out the step of purging each of said beverage containers;

said step of purging is carried out with a carbon dioxide containing gas;

said step of filling each of said sealed beverage containers is carried out under gravity flow of said non-carbonated liquid beverage filling material at atmospheric pressure;

said step of filling each of said sealed beverage containers with non-carbonated liquid beverage filling material comprises pressurizing said non-carbonated liquid beverage filling material to a pressure higher than a prevailing pressure in said beverage containers;

after said step of introducing carbon dioxide gas into the non-carbonated liquid beverage filling material, to carbonate said non-carbonated liquid beverage filling material, reducing a prevailing pressure in said beverage containers to atmospheric pressure; and wherein:

reducing a prevailing pressure to atmospheric pressure is carried out by one of (i.) and (ii.):

(i.) in one step to atmospheric pressure; and (ii.) in two steps; said two steps comprising (I.) and (II.):

(I.) reducing a prevailing pressure to a predepressurizing pressure above atmospheric pressure; and (II.) reducing the pressure from said predepressurizing pressure to atmospheric pressure; and said beverage containers comprise one of (i.) and (ii.):

(i.) bottles, and (ii.) cans.

14. A plant for filling beverage containers with liquid beverage filling material and carbonating the liquid beverage filling material in beverage containers with carbon dioxide gas, said plant comprising:

a beverage filling machine;

said beverage filling machine comprising a plurality of beverage filling positions, each beverage filling position comprising a beverage filling device for filling beverage containers;

apparatus configured to move beverage containers to be filled to said filling machine;

apparatus configured to seal beverage containers to be filled against corresponding beverage filling devices;

said filling devices comprising apparatus configured to introduce a flow of liquid beverage filling material into the interior of sealed beverage containers to fill sealed beverage containers to a substantially predetermined level with liquid beverage filling material;

said apparatus configured to introduce a flow of liquid beverage filling material comprising apparatus configured to terminate the filling of beverage containers upon reaching said substantially predetermined level in sealed beverage containers;

apparatus configured to introduce carbon dioxide gas into the liquid beverage filling material in sealed beverage containers at a pressure sufficient to produce a carbonated beverage in sealed beverage containers from liquid beverage filling material in beverage containers;

said apparatus configured to introduce carbon dioxide gas comprising apparatus configured to terminate introduction of carbon dioxide gas;

apparatus configured to distance beverage containers, filled with a carbonated beverage from the beverage filling devices; and said plant further comprising:

a container closing arrangement configured to close carbonated beverage filled containers with closing devices;

said container closing sealing arrangement comprising:

apparatus configured to position carbonated beverage filled containers in said container closing arrangement; and apparatus configured to close carbonated beverage filled containers with a closing device and prevent from substantially leaking from carbonated beverage filled containers a carbonated beverage.

15. The plant according to claim 14, wherein:

said apparatus configured to introduce a flow of liquid beverage filling material into the interior of sealed beverage containers comprises apparatus configured to introduce non-carbonated liquid beverage filling material into the interior of beverage containers sealed by said apparatus configured to seal the beverage containers to be filled against corresponding beverage filling devices.

16. The plant according to claim 14, wherein:

said apparatus configured to introduce carbon dioxide gas into the liquid beverage filling material comprises apparatus configured to carbonate liquid beverage filling material;

said apparatus configured to carbonate liquid beverage filling material comprises a carbonation tube configured with a gas opening at its end adapted to be submerged in liquid beverage filling material; said end projecting a substantial distance from a corresponding filling device into a corresponding beverage container.

17. The plant according to claim 14, wherein:

said apparatus configured to introduce carbon dioxide gas into the liquid beverage filling material comprises apparatus configured to carbonate liquid beverage filling material;

said apparatus configured to carbonate said liquid beverage filling material comprises a carbonation tube and said apparatus configured to carbonate is configured with a gas outlet near the top of a corresponding beverage container.

18. The plant according to claim 17, wherein:

each filling device comprises a return gas channel; and said carbonation tube projects from an opening of said return gas channel beyond the lower side of a corresponding filling device into a corresponding container; and said plant further comprising:

a control arrangement to control operation of at least said apparatus to introduce a flow of liquid beverage filling material into the interior of sealed beverage containers, and said apparatus to introduce carbon dioxide gas into liquid beverage filling material in sealed beverage containers.

19. The plant according to claim 14, comprising all of:

said apparatus configured to introduce carbon dioxide gas into liquid beverage filling material comprises a carbonation tube configured with a gas opening at its end adapted to be submerged in liquid beverage filling material; said end projecting a substantial distance from a corresponding filling device into a corresponding beverage container;

each filling device comprises a return gas channel; and said carbonation tube projects from an opening of said return gas channel beyond the lower side of a corresponding filling device into a corresponding container;

a control arrangement to control operation of at least said apparatus to introduce a flow of liquid beverage filling material into the interior of sealed beverage containers.

20. A method of operating a plant to produce a carbonated beverage by filling beverage containers with liquid beverage filling material and carbonating said liquid beverage filling material in said beverage containers with carbon dioxide gas using a beverage filling arrangement and a container closing arrangement, said beverage filling arrangement having a plurality of beverage filling positions, each beverage filling position comprising a beverage filling device for filling beverage containers, said method comprising the steps of:

moving beverage containers to be filled to said beverage filling arrangement;

sealing the beverage containers to be filled against corresponding beverage filling devices;

introducing a flow of liquid beverage filling material into the interior of said sealed beverage containers;

filling said sealed beverage containers to a substantially predetermined level with liquid beverage filling material;

introducing carbon dioxide gas into the liquid beverage filling material in said sealed beverage containers at a pressure sufficient to produce a carbonated beverage from said liquid beverage filling material in said sealed beverage containers by mixing said liquid beverage filling material and carbon dioxide gas in said sealed beverage containers and producing a carbonated beverage in said sealed containers;

terminating the step of introducing carbon dioxide gas;

terminating the step of filling said sealed beverage containers upon reaching said substantially predetermined level of liquid beverage filling material in said sealed beverage containers;

distancing beverage containers filled with said carbonated beverage from the beverage filling devices;

said method further comprising the steps of:

moving said beverage containers filled with said carbonated beverage from said beverage filling arrangement;

moving said beverage containers filled with said carbonated beverage into said container closing arrangement; and closing said beverage containers filled with said carbonated beverage with closing devices and thus preventing the carbon dioxide in said beverage containers filled with said carbonated beverage from substantially leaking from said beverage containers filled with said carbonated beverage at least prior to shipping;

said method yet further comprising the step of:

preparing the closed beverage containers filled with said carbonated beverage for shipping from said plant to consumers.

* * * * *

UNITED STATES PATENT AND TRADEMARK OFFICE

CERTIFICATE OF CORRECTION

PATENT NO. : 6,463,964 B2
DATED : October 15, 2002
INVENTOR(S) : Ludwig Clüsserath It is certified that error appears in the above-identified patent and that said Letters Patent is hereby corrected as shown below:

Title page,
Item [57], ABSTRACT,
Delete the entire ABSTRACT paragraph and insert the following:

--There is now provided a method and apparatus for filling beverage containers, comprising beverage bottles or beverage cans, with a beverage in a plant to produce a carbonated beverage. The liquid filling material introduced into a beverage container is substantially without carbon dioxide content, or with a carbon dioxide content that is substantially below the level of the carbon dioxide content of a carbonated beverage. The liquid filling material is carbonated in the container by mixing with carbon dioxide introduced under pressure sufficient to effectuate mixing of the liquid filling material with carbon dioxide to produce a carbonated liquid beverage.--.

Column 4,
Line 34, after “"inventions"”, insert -- , --.
Line 35, after “tion"”, insert -- . --.
Line 24, after “such”, delete “a” and insert -- as --.
Line 59, after “is”, delete “s” and insert -- a --.

Column 8,
Line 13, after “of”, delete “thee” and insert -- the --.

Column 10,
Line 33, after “opening”, delete “21” and insert -- 2’ --.

UNITED STATES PATENT AND TRADEMARK OFFICE

CERTIFICATE OF CORRECTION

PATENT NO. : 6,463,964 B2
DATED : October 15, 2002
INVENTOR(S) : Ludwig Clüsserath It is certified that error appears in the above-identified patent and that said Letters Patent is hereby corrected as shown below:

Column 22,
Line 40, after "on", delete "Mach" and insert -- March --.
Line 45, after "et al.", delete "an" and insert -- on --.

Column 29,
Line 44, after "09/282,975" delete "38,613".

Signed and Sealed this

Tenth Day of June, 2003

JAMES E. ROGAN
*Director of the United States Patent and Trademark Office*